US011291879B1

(12) United States Patent
Khubani et al.

(10) Patent No.: US 11,291,879 B1
(45) Date of Patent: Apr. 5, 2022

(54) EXERCISE MACHINE

(71) Applicant: DaVinci II CSJ, LLC, Fairfield, NJ (US)

(72) Inventors: Ajit Khubani, Saddle River, NJ (US); Paul Dowd, Scarsdale, NJ (US); Damian Mucaro, Hackensack, NJ (US)

(73) Assignee: DaVinci II CSJ, LLC, Fairfield, NJ (US)

( * ) Notice: Subject to any disclaimer, the term of this patent is extended or adjusted under 35 U.S.C. 154(b) by 0 days.

(21) Appl. No.: 17/230,984

(22) Filed: Apr. 14, 2021

(51) Int. Cl.
*A63B 21/22* (2006.01)
*A63B 21/015* (2006.01)
*A63B 22/00* (2006.01)

(52) U.S. Cl.
CPC ..... *A63B 21/225* (2013.01); *A63B 21/015* (2013.01); *A63B 22/0023* (2013.01)

(58) Field of Classification Search
CPC ..... A63B 21/22; A63B 21/222; A63B 21/225; A63B 21/227; A63B 21/012; A63B 21/0125; A63B 21/015; A63B 21/02; A63B 21/06; A63B 21/0608; A63B 21/0609; A63B 21/0615; A63B 21/0616; A63B 21/0617; A63B 21/0618; A63B 21/0664; A63B 69/16; A63B 22/0023; A63B 22/0025; A63B 22/00; A63B 22/0015; A63B 22/0017; A63B 22/0056; A63B 22/0058; A63B 22/0061; A63B 22/0064; A63B 22/0066; A63B 22/0069; A63B 22/04; A63B 22/06; A63B 22/0605; A63B 22/0664; A63B 2022/002; A63B 2022/0028; A63B 2022/003; A63B 2022/0033; A63B 2022/0053; A63B 2022/0611; A63B 2022/0617; A63B 2022/0623; A63B 2022/0629;
(Continued)

(56) References Cited

U.S. PATENT DOCUMENTS 1,496,934 A 6/1924 Holtz
3,547,434 A * 12/1970 Ossenkop ..... A63B 69/18 482/71

(Continued)

OTHER PUBLICATIONS

International Search Report and Written Opinion dated Sep. 17, 2021 in connection with International Application No. PCT/US2021/028994.

(Continued)

*Primary Examiner* — Megan Anderson
*Assistant Examiner* — Thao N Do
(74) *Attorney, Agent, or Firm* — Wolf, Greenfield & Sacks, P.C.

(57) ABSTRACT

Embodiments disclosed herein relate to exercise machines. In some embodiments, the device may include a resistance adjuster configured to adjust the difficulty of an exercise performed on the exercise machine. Particularly, the exercise machine may include a knob configured to modify the resistance in even steps. The exercise machine also may include functional components, such as pulleys, for transmitting a drive force from a user to a resistive body. The functional components may be operatively connected via one or more belts. In some embodiments, the exercise machine may include one or more belt tensioners to regulate the tension of the one or more belts.

10 Claims, 20 Drawing Sheets

(58) Field of Classification Search
CPC .... A63B 2022/0635; A63B 2022/0641; A63B 2022/0647; A63B 2022/0652; A63B 2022/067; A63B 2022/0676; A63B 2022/0682; A63B 2022/0688; A63B 23/00; A63B 23/035; A63B 23/03508; A63B 23/03516; A63B 23/03525; A63B 23/03533; A63B 23/03541; A63B 23/0355; A63B 23/04; A63B 23/0405; A63B 23/0458; A63B 23/0475; A63B 23/0417; A63B 23/0423; A63B 23/0429
USPC ..... 482/51
See application file for complete search history.

(56) References Cited

U.S. PATENT DOCUMENTS 3,779,548 A * 12/1973 Sato ..... A63B 23/16 482/44
3,811,421 A * 5/1974 Betten ..... A63B 69/406 124/78
3,831,942 A * 8/1974 Del Mar ..... A63B 21/015 482/72
3,917,261 A * 11/1975 Small ..... A61H 1/0266 482/8
4,332,380 A * 6/1982 Cardin ..... A63B 21/00043 482/126
4,632,384 A * 12/1986 Bright ..... A63B 23/03508 482/49
4,869,492 A * 9/1989 Joutras ..... A63B 5/20 482/44
5,176,601 A * 1/1993 Reynolds ..... A63B 23/03525 482/121
5,685,804 A * 11/1997 Whan-Tong ..... A63B 22/001 482/51
5,860,941 A * 1/1999 Saringer ..... A63B 21/0058 601/33
5,947,868 A * 9/1999 Dugan ..... A63F 13/005 482/4
D481,085 S * 10/2003 Ben-Moshe ..... D21/668
D496,700 S * 9/2004 Chen ..... D21/668
D519,583 S * 4/2006 Chen ..... D21/668
7,041,037 B2 5/2006 Huang
7,231,853 B1 * 6/2007 Burdge ..... A63B 27/00 7/143
7,314,432 B2 1/2008 Liao
D569,455 S * 5/2008 Dukhande ..... D21/668
7,385,324 B2 * 6/2008 Lin ..... A63B 21/0051 310/74
D575,836 S 8/2008 Hsiao
7,485,073 B2 * 2/2009 Chang ..... A63B 21/00196 482/51
7,695,410 B2 * 4/2010 Kim ..... A63B 22/0605 482/57
7,901,331 B1 * 3/2011 Stoll ..... A63B 22/0694 482/52
8,052,581 B1 * 11/2011 Lohr ..... A63B 21/015 482/63
D684,222 S * 6/2013 Kim ..... D21/662
D728,707 S 5/2015 Colburn
D771,204 S * 11/2016 Ho ..... D21/668
D773,567 S * 12/2016 Chuang ..... D21/668
9,662,534 B1 * 5/2017 Liu ..... A63B 21/157
9,713,739 B2 7/2017 Dalmia
D793,494 S 8/2017 Mansfield et al.
D796,591 S 9/2017 Ho et al.
9,757,611 B1 * 9/2017 Colburn ..... A63B 22/0694
D822,773 S 7/2018 Khubani
10,080,918 B2 9/2018 Dalmia
D843,502 S * 3/2019 Hsieh ..... D21/668
10,252,102 B2 * 4/2019 Dalmia ..... A63B 22/0046
10,569,124 B2 2/2020 Dalmia et al.
D906,445 S * 12/2020 Colburn ..... A63B 22/0694 D21/663
2002/0094914 A1 * 7/2002 Maresh ..... A63B 21/068 482/51
2003/0036462 A1 * 2/2003 Ravikumar ..... A61H 1/0266 482/51
2004/0009848 A1 * 1/2004 Lee ..... A63B 22/0605 482/57
2005/0020410 A1 1/2005 Chang
2005/0037902 A1 2/2005 Charnitski
2005/0124471 A1 * 6/2005 Wilkinson ..... A63B 21/153 482/121
2005/0153153 A1 * 7/2005 Saur ..... A63B 71/148 428/542.8
2005/0227831 A1 * 10/2005 Mills ..... A63B 21/4001 482/106
2005/0288155 A1 * 12/2005 Yang ..... A63B 22/001 482/52
2007/0167288 A1 * 7/2007 Lin ..... A63B 23/16 482/49
2007/0167300 A1 * 7/2007 Krull ..... A63B 21/0728 482/107
2008/0058168 A1 * 3/2008 Lin ..... A63B 22/208 482/52
2008/0076639 A1 * 3/2008 Fon ..... A63B 22/0664 482/62
2008/0103026 A1 * 5/2008 An ..... A63B 21/023 482/49
2008/0194388 A1 * 8/2008 Chen ..... A63B 22/0664 482/52
2009/0011907 A1 * 1/2009 Radow ..... A63B 24/0084 482/57
2009/0149300 A1 * 6/2009 Chen ..... A63B 22/0694 482/63
2010/0035710 A1 * 2/2010 Smith ..... A63B 43/06 473/570
2010/0210425 A1 * 8/2010 Bowser ..... A63B 21/4049 482/62
2012/0238406 A1 * 9/2012 Beard ..... A63B 21/227 482/2
2013/0139797 A1 * 6/2013 Oblack ..... A63B 37/12 124/5
2013/0260907 A1 * 10/2013 Kordecki ..... A63B 71/04 473/61
2014/0274622 A1 * 9/2014 Leonhard ..... A47C 7/62 482/142
2015/0045190 A1 * 2/2015 Keiser ..... A63B 21/0051 482/57
2015/0165293 A1 * 6/2015 Hamilton ..... A63B 69/0059 473/453
2015/0182839 A1 * 7/2015 Taylor ..... A63B 22/001 482/52
2015/0335936 A1 * 11/2015 Shakespeare ..... A63B 21/225 482/58
2015/0352402 A1 * 12/2015 Arnold ..... A63B 21/225 482/57
2016/0107026 A1 * 4/2016 Hsu ..... A63B 22/0058 482/80
2016/0263416 A1 * 9/2016 Golesh ..... A63B 21/00069
2016/0317859 A1 * 11/2016 Dalmia ..... A63B 22/06
2017/0036053 A1 * 2/2017 Smith ..... A63B 71/0054
2017/0106261 A1 * 4/2017 DePaoli ..... A63B 60/14
2017/0144054 A1 * 5/2017 Landau ..... A41D 13/082
2017/0216660 A1 * 8/2017 Lernihan ..... A63B 22/0664
2017/0239506 A1 * 8/2017 Gibson ..... A63B 21/0051
2017/0252603 A1 * 9/2017 Wu ..... A63B 21/159
2017/0347727 A1 * 12/2017 Bailey ..... A63B 71/146
2017/0361184 A1 * 12/2017 Roy ..... A41D 19/0024
2018/0015321 A1 * 1/2018 Ho ..... A63B 21/00069
2018/0169458 A1 * 6/2018 Hao ..... A63B 21/00065
2018/0200582 A1 * 7/2018 Thurman ..... A63B 43/004
2018/0207474 A1 7/2018 Chen
2018/0280753 A1 * 10/2018 Krull ..... A63B 21/015
2018/0369643 A1 * 12/2018 Huang ..... A63B 21/015
2019/0223527 A1 * 7/2019 George ..... A63B 71/146
2019/0232106 A1 * 8/2019 Dalmia ..... A63B 21/0051
2019/0299053 A1 * 10/2019 Friedman ..... A63B 22/0605
2019/0323792 A1 * 10/2019 Tafoya ..... G09B 19/0038
2020/0016452 A1 * 1/2020 Dalmia ..... H04M 1/72403

(56) References Cited

U.S. PATENT DOCUMENTS

| | | | | |
|---|---|---|---|---|
| 2020/0129804 | A1 | 4/2020 | Colburn | |
| 2020/0147435 | A1* | 5/2020 | Gibson | A63B 21/0051 |
| 2020/0338383 | A1* | 10/2020 | Liu | A63B 21/225 |
| 2021/0138304 | A1* | 5/2021 | Mason | A63B 24/0062 |

OTHER PUBLICATIONS

PCT/US2021/028994, Sep. 17, 2021, International Search Report and Written Opinion.

[No. Author Listed], Perlecare, announced 2020 [online], [site visited Nov. 19, 2021]. Available on internet, URL: https://www.amazon.com/PERLECARE-Elliptical-Portable-Adjustable-Resistance/dp/B08MTHQD62/ref (Year: 2020).

[No. Author Listed], Ativafit, announced 2019 [online], [site visited Nov. 19, 2021]. Available on internet, URL: https://www.amazon.com/ATIVAFTr-Elliptical-Exerciser-Adjustable-Resistance/dp/B07TPJ3WWM/ref (Year: 2019).

* cited by examiner

EXERCISE MACHINE

FIELD

Disclosed embodiments relate to exercise machines, for example, elliptical machines.

BACKGROUND

As is known, exercise machines provide users with a variety of exercise experiences, such as in a commercial gym or in the comfort of their own home. Such machines may allow users to change the type and/or intensity of an exercise experience. For example, a treadmill may allow a user to change the speed, incline, and/or resistance while exercising.

BRIEF SUMMARY

According to one embodiment, a resistance adjuster for an exercise apparatus includes an array of magnets, a flywheel having a conductive surface, a rod configured to move the array of magnets relative to the flywheel, the rod having a first end operatively coupled to the array of magnets and a second end opposite the first end, and a knob operatively coupled to the second end of the rod such that the rod selectively moves the array of magnets towards and/or away from the flywheel as the knob is operated. When the knob is operated, an angle between the rod and the array of magnets and an angle between the rod and the knob changes.

According to another embodiment, a tensioning system for an exercise apparatus includes a first pulley configured to receive a driving force, a second pulley operatively connected to the first pulley via a first belt, a third pulley operatively connected to the second pulley, an axle coaxially connected to the second pulley and the third pulley, a flywheel operatively connected to the third pulley via a second belt, a first belt tensioner having at least two eccentric shaft supports disposed between the second and third pulleys, wherein the at least two eccentric shaft supports are configured to modify the tension of the second belt when the at least two eccentric shaft supports are rotated, and a second belt tensioner having a ball bearing and a support arm, wherein the ball bearing is mounted to a first end of the support arm and pivotable about a second end of the support arm, the ball bearing being configured to contact the first belt.

According to another embodiment, an exercise machine includes a housing, first and second pedals attached to the housing via a crank arm, the crank arm attachable to the housing via first and second bearings, one or more feet attached to the housing for stably resting the housing on a surface, and a support brace extending between the crank arm attached to the first pedal and the feet to transfer input forces form the first and second pedals to the feet.

It should be appreciated that the foregoing concepts, and additional concepts discussed below, may be arranged in any suitable combination, as the present disclosure is not limited in this respect. Further, other advantages and novel features of the present disclosure will become apparent from the following detailed description of various non-limiting embodiments when considered in conjunction with the accompanying figures.

BRIEF DESCRIPTION OF DRAWINGS

Non-limiting embodiments of the present disclosure will be described by way of example with reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the disclosure shown where illustration is not necessary to allow those of ordinary skill in the art to understand the disclosure. In the figures.

DETAILED DESCRIPTION

Figure 1:
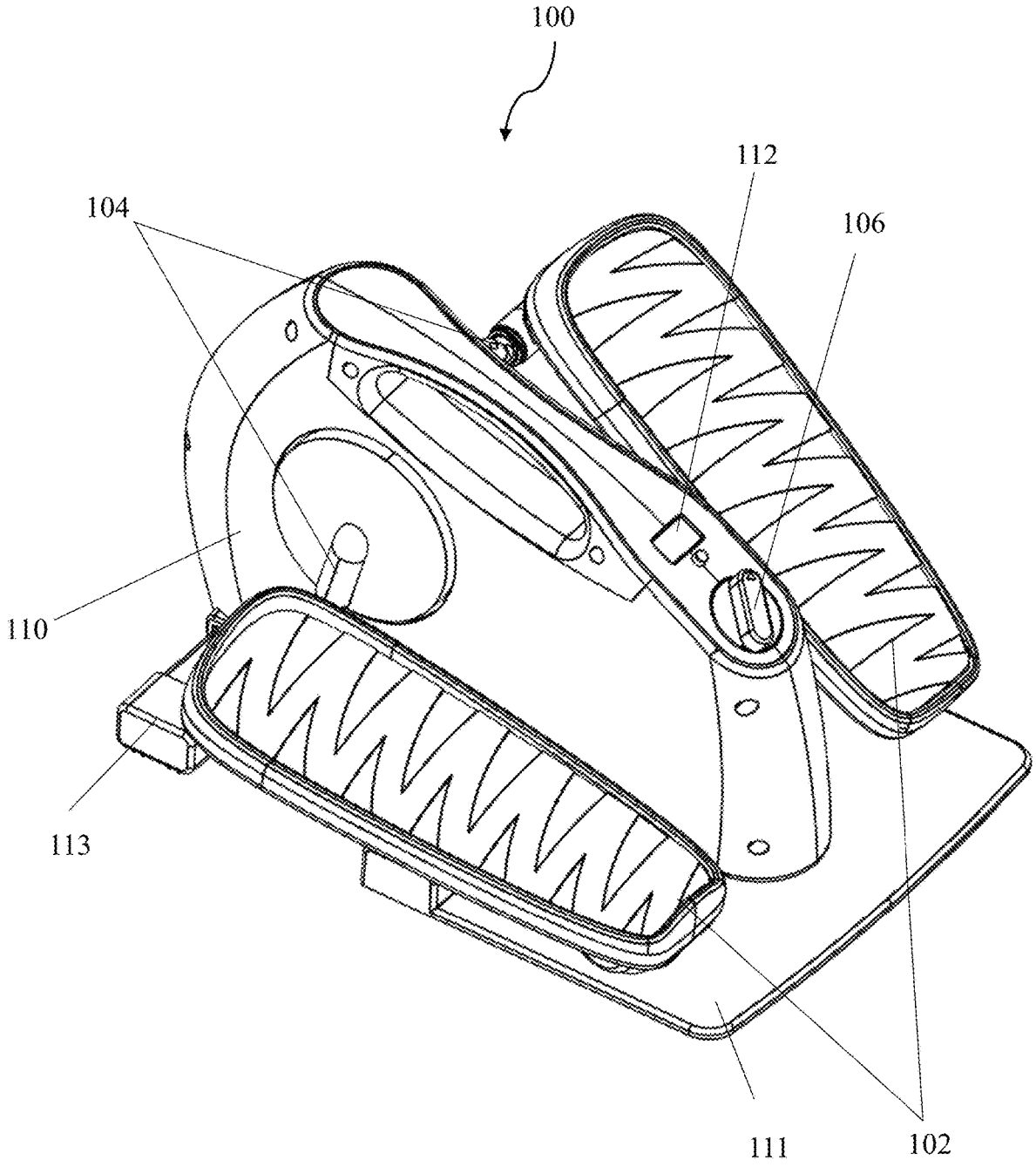
FIG. 1 is a perspective view of an exercise machine according to one illustrative embodiment.

As is known, exercise machines may be used to provide an exercise experience to a user, such as in a commercial gym or in the comfort of their own home. For example, an elliptical machine may provide a walking and/or running experience to a user during an exercise program.

To accommodate a variety of uses and skill levels, a conventional exercise machine may include features that allow a user to modify the type and/or difficulty of exercise being performed with the exercise machine. For example, in some instances, an exercise machine (e.g., a stationary bicycle or an elliptical machine) may include a control panel and/or knob to modify the program and/or difficulty level of a particular program. In some embodiments such a knob may allow the user to modify the resistance of the exercise. Some typical exercise machines allow a user to adjust the resistance by turning or otherwise operating the knob. The Inventor has recognized that in some instances, the control panel and/or knob on typical exercise machines may progress resistance in unequal or unbalanced increments. For example, in some instances, an increase in resistance between two lower levels (e.g., levels 1 and 2) may differ from an increase in resistance between two upper levels (e.g., between levels 5 and 6) of the exercise machine.

In view of the above, the Inventor has recognized the advantages of an exercise machine having the ability to modify resistance using an actuator, such as a knob, in equal or balanced increments. In some embodiments, the exercise device may include a resistance adjuster which may be arranged to adjust the level of resistance during an exercise experience. In some embodiments of the present disclosure, the resistance adjuster may include an eddy current brake.

For example, in some embodiments, the resistance adjuster may include fly wheel having a conductive surface and an array of magnets configured to induce an eddy current in the conductive surface. In some embodiments, the flywheel may include a thin conductive band, such as one formed of an aluminum material. In such embodiments, the band (e.g., a tire), may be disposed on an outer surface of the flywheel. In some embodiments, the flywheel may be formed of iron with a conductive surface.

In some embodiments, the array of magnets may be movable relative to flywheel via the actuator (e.g., a knob and tie rod, as will be described) to modify a resistance associated with the flywheel. For example, in some embodiments, as the array of magnets is moved in a direction towards the flywheel (and the conductive surface), the resistance may increase. In some embodiments, as the array of magnets is moved in a direction away from the flywheel (and the conductive surface), the resistance may decrease. Without wishing to be bound by theory, in some embodiments, the resistance may increase exponentially as the array of magnets is approximated to the flywheel. The resistance also may decrease exponentially as the array of magnets is moved in a direction away from the flywheel. As will be appreciated, although described as having an array of magnets, in some embodiments, a single, larger magnet may be moved relative to the flywheel to vary resistance.

In some embodiments, the resistance adjuster according to the present disclosure may include a system that scales the resistance in approximately equal stages, irrespective of the exponential relationship between resistance and the distance of the array of magnets from the ferromagnetic body. In some embodiments, such balanced resistance adjustments may be achieved by a tie rod that operatively connects a knob to the array of magnets.

In some embodiments, a tie rod may be configured to move the array of magnets such that the resistance is increased a fixed amount as the knob is operated (e.g., turned a first distance in a first direction). For example, in some embodiments, the rod may include a straight body portion. with a first end being attached to the array of magnets and the second end attached to the knob. In such embodiments, the second end of the rod may transfer the input from the knob to the array of magnets, thus moving the array of magnets relative to the flywheel. In some embodiments, an angle of the rod relative to the knob and an angle of the rod relative to the array of magnets may be modified as the knob is turned to move the array of magnets relative to the flywheel. In such embodiments, the magnetic array may be moved in unequal (e.g., exponentially reducing) increments as the knob is turned in equal or approximately equal increments.

As will be appreciated, the rod may be attachable to the magnet array and/or knob via any suitable arrangements. For example, in some embodiments, each of the ends of the rod may have a geometric arrangement, such as a Z-shaped, to engage with the knob and the magnet array. In some embodiments, one of the Z-shaped end portions may be configured to be driven by the knob (e.g., receive input from the knob), while the other Z-shaped end portions may interact with the array of magnets. Each end of the rod also may include C-shape, U-shape, S-shape, or other suitable shape for engaging with the knob and with the magnet array. The rod also may be attached to the magnet array and/or the knob via one or more fasteners.

In some embodiments, a knob may include a series of detents corresponding to incremental resistance or intensity levels (e.g., a level of difficulty of the exercise experience). In some embodiments, the detents may be spaced along a body of the knob. For example, the detents may be circumferentially spaced about the knob, with the knob configured to be operated using a circular motion. As described herein, the detents may be placed such that the resistance is modified by approximately an equal amount when the knob is turned from one detent to a second, adjacent detent. As will be appreciated, the detents may be evenly spaced about the knob, although the detents also may be arranged in other suitable manners.

The Inventor has also recognized the benefit of having an exercise device with a predominately plastic design. For example, such plastic designs may be easier to produce, may be easier for a user to operate (e.g., move around), and may be less expensive to produce and/or ship. As will be appreciated, most exercise devices include predominately welded steel portions that are heavy. The Inventor has recognized that such a predominately plastic design may preclude use of existing systems of traditional exercise devices, such as existing belt tensioning systems, and existing foot pedals. The Inventor has also recognized the benefits of using strategically placed metal supports, such support braces, for distributing input load during use.

In some embodiments disclosed herein, it may be desirable to spin a resistive body (e.g., a flywheel) at a speed higher than an input body (e.g., a pedal connected to a crank arm) for transferring a driving force (e.g., from the user during exercise) to the resistive body. Such a design may be efficient and compact, in some embodiments. Accordingly, in some instances, an exercise machine may be formed with one or more bodies that are operatively connected such that the drive force (e.g., provided by a user when exercising) is transferred to the resistive body (e.g., a ferromagnetic body, as described above). In some embodiments, the operatively connected bodies may be connected to one another via one or more belts.

As recognized by the Inventor, the one or more belts may need to be tensioned during manufacturing such that the belts remain taught when a user performs an exercise on the exercise machine. As will be appreciated, if the belts are too loose, they will slip, and if the belts are too tight, they may not allow for proper movement of the pedals. As will be further appreciated, the belts may not be stretchable. Accordingly, the exercise machine may be designed to account for manufacturing tolerances. The exercise machine also may be designed for ease of manufacturing. For example, in some embodiments, the machine may be designed with exact spacing between the pulleys. In such embodiments, in may be difficult to assemble the belts in a tensioned state. In still another embodiment, the belts may need to be re-tensioned during assembly.

In view of the above, the Inventor has recognized the advantages of an exercise machine that includes a tensioning system that allows the manufacturer to easily modify the tension of the one or more belts when needed, such as after assembling a pulley sub assembly and/or attaching the pulley sub assembly to the housing. In some embodiments described herein, the system may include first and second belt tensioners. In some embodiments, the exercise machine may include a first pulley operatively connected to a drive axle configured to transmit a drive force (e.g., from a user via pedals connected to the drive axle). In turn, the first pulley may be operatively connected to a second pulley via a first belt. The second pulley may be operatively connected to a third pulley (e.g., by being attached to or formed with the body of the third pulley). The third pulley may then be connected to a resistive body (e.g., the ferromagnetic resistive flywheel described herein) via a second belt. In such embodiments, each of the first and second belts may include a dedicated tensioning system for setting the tension of the associated belt.

In some embodiments, the second belt may be tensioned first via a first belt tensioner having two shaft supports. In such embodiments, a first shaft support may be operatively connected to the second pulley and a second shaft support may be operatively connected to the third pulley. As described herein, the two shaft supports may be eccentric with a socket for a first end of a shaft eccentrically placed relative to the outside diameter of the shaft support located in the housing of the exercise machine.

In such embodiments, as the shaft supports rotate in the housing, a first shaft is moved in an eccentric fashion relative to the housing. In other words, the first shaft may move in a circular path that is not centered on the shaft itself, but is rather offset (e.g., eccentric). For example, in some embodiments, the two eccentric shaft supports may be configured such that the two eccentric shaft supports move in an arc relative to the housing when rotated. In such embodiments, movement of the shaft supports (e.g., rotating the shaft supports) may move the second and third pulleys relative to the first pulley. In such embodiments, the supports may be rotated until a desired tension of the second belt is achieved. In some embodiments, once a desired tension of the second belt is achieved, the shaft supports may be selectively locked in place relative to the housing.

In some embodiments, the first belt may thereafter be tensioned via a second belt tensioner having a ball bearing in contact with the first belt. The ball bearing may be positioned at or near a first end of a support arm, while a second end of the support arm is pivotably fixed to a portion of the exercise machine. Thus, the support arm may be free to pivot about the second end. As the support arm (and by extension the ball bearing) is pivoted towards the first belt, the tension in the first belt may increase, while as the support arm (and by extension the ball bearing) is pivoted away from the first belt, the tension in the first belt decreases. In some embodiments, a bolt may control the position (e.g., liner position and/or angular position) of the support arm. The bolt may be configured such that when the bolt is tightened, the tension in the first belt is decreased. The bolt may also be configured such that as the bolt is loosened, the tension in the first belt is increased. Of course, in some embodiments, the bolt may be configured to function in the opposite manner such that the tension is increased when the bolt is tightened and the tension is decreased when the bolt is loosened, depending on the application. In some embodiments, the bolt may be selectively lockable (e.g., by a manufacturer) so as to maintain a particular tension in the first belt.

In some embodiments, the exercise machine may be configured to be relatively small and lightweight such that the exercise machine is easily portable. For example, in some embodiments, one or more components of the exercise machine is formed from a lightweight plastic. For example, in some embodiments, the pedals of the exercise machine may be formed from plastic. Additionally, a frame of the exercise machine may be formed from plastic. In some instances, portions of a housing for the internal components of the exercise machine also may be made from plastic. Of course, any suitable component of the exercise machine may be formed from plastic, depending on the application. As will be appreciated, one or more portions of the exercise machine also may be formed of metal, such as for stability and/or for load transfer. For example, in some embodiments, a support brace may be connected between the crank shaft and the feet to distribute input load from pedaling.

In some embodiments, the exercise machine may have a weight of less than or equal to 15 lbs, 14 lbs, 13 lbs, and/or another appropriate weight. The exercise machine also may have a weight of greater than or equal to 8 lbs, 9 lbs, 10 lbs, and/or another appropriate weight. Combinations of the above-noted ranges are also contemplated, including, but not limited to, weights between 8 lbs and 15 lbs, between 9 lbs and 14 lbs, and between 10 lbs and 13 lbs. Of course, the exercise machine may be configured with any suitable weight, depending on the application.

Turning now to the figures, specific non-limiting embodiments are described in further detail. It should be understood that the various systems, components, features, and methods described relative to these embodiments may be used either individually and/or in any desired combination as the disclosure is not limited to only the specific embodiments described herein.

FIG. 1 shows a perspective view of an exercise machine 100 according to one embodiment of the present disclosure. In some embodiments, as shown in this figure, the exercise machine 100 may include an elliptical machine 100, which allows a user to exercise by applying a force to the machine, such as by pedaling pedals 102 with their legs and/or feet. As will be appreciated, the pedals may be sized to accept a user's feet. For example, as shown in FIG. 1, each pedal may be substantially rectangular for receiving the user's foot.

In some embodiments, the pedals are connected to a housing 110. In some embodiments, the housing may be attached to a support 111 and to one or more feet 113. In some embodiments, the support and feet may allow the exercise device to rest stably on a surface (e.g., a floor). In some embodiments, the support includes a substantially planar surface. In some embodiments, each pedal includes a wheel that slides across the planar support. For example, as the user applies a force and moves the pedals in a circular or elliptical motion, the wheels may slide back and forth across the support.

In some embodiments, the pedals 102 may be constructed and arranged such that the pedals 102 add minimal weight to exercise machine 100. For example, in some embodiments, the pedals 102 may be primarily constructed from a lightweight material, such as plastic. In some embodiments, the pedals 102 may include one or more features to provide the pedals 102 with structural rigidity. Such features may provide support, such as when the pedal is under load, for example, when a user is operating the exercise machine 100.

Figure 21:
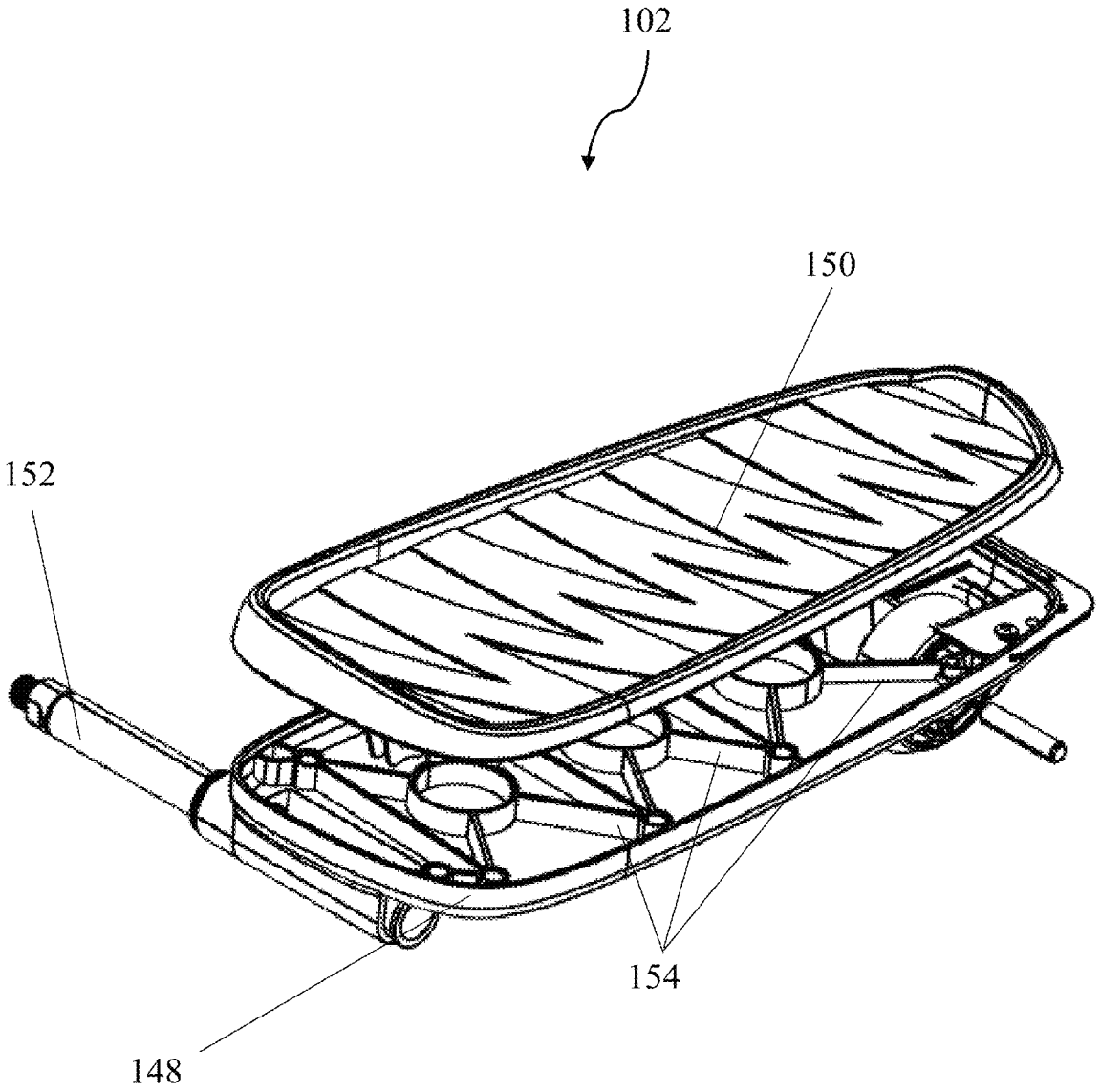
FIG. 21 an exploded view of a pedal of the exercise machine of FIG. 2.

In some embodiments, the body of each pedal 102 may be formed from a plastic base 148 and a plastic cover 150. In such embodiments, such construction may allow the pedals to maintain structural rigidity when under load, such as when a user is operating the exercise machine. In some embodiments, the base 148 may include a plurality of ribs 154 extending from base 148 and towards plastic cover 150. The cover also may include a plurality of ribs extending in a direction towards the base. As will be appreciated, the ribs may have any suitable shape, arrangement, and thickness. As will be appreciated, the pedals 102 also may be constructed form other suitable materials, such as a lightweight carbon fiber or composite materials. The pedals also may have one or more portions formed of metal, such as a shaft 152 (see FIGS. 2 and 21) that connect the pedal to the housing, as will be described. In some embodiments, the shaft may be formed of a steel material.

In some embodiments, each pedal 102 is connected to the housing and to a drive assembly via a crank arm 104. In some embodiments, the pedal may be connected to the crank arm via a shaft 152. In such embodiments, the shaft may be connected to the crank arm (e.g., via one or more fasteners or other suitable arrangements). In such embodiments, as the user applies the force to the pedals 102, the crank arm 104 may rotate about the housing. As will be appreciated, the crank arm may rotate about a pivot axis defined by an axle portion 153 extending through the pulleys and/or fly wheel. In some embodiments, the user may transfer force and/or torque to the internal components of the exercise device via the pedals.

Figure 9:
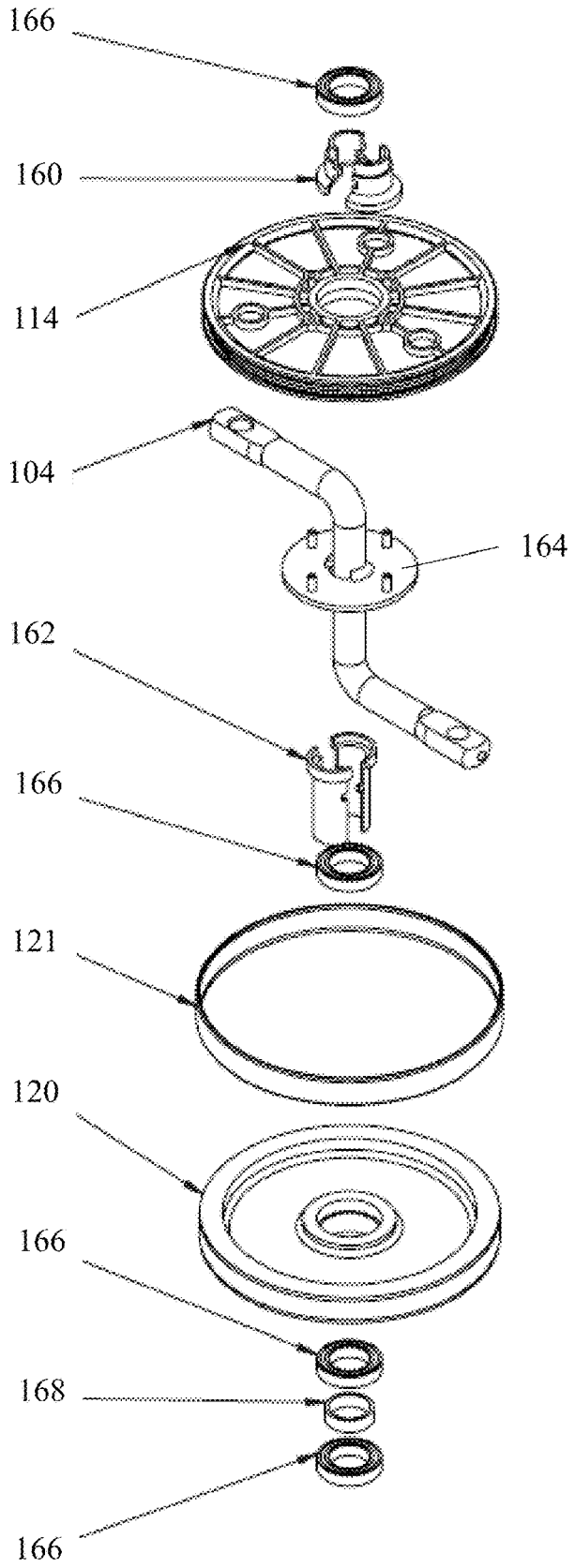
FIG. 9 is an exploded view of the pulley sub-assembly of FIG. 7.
Figure 10:
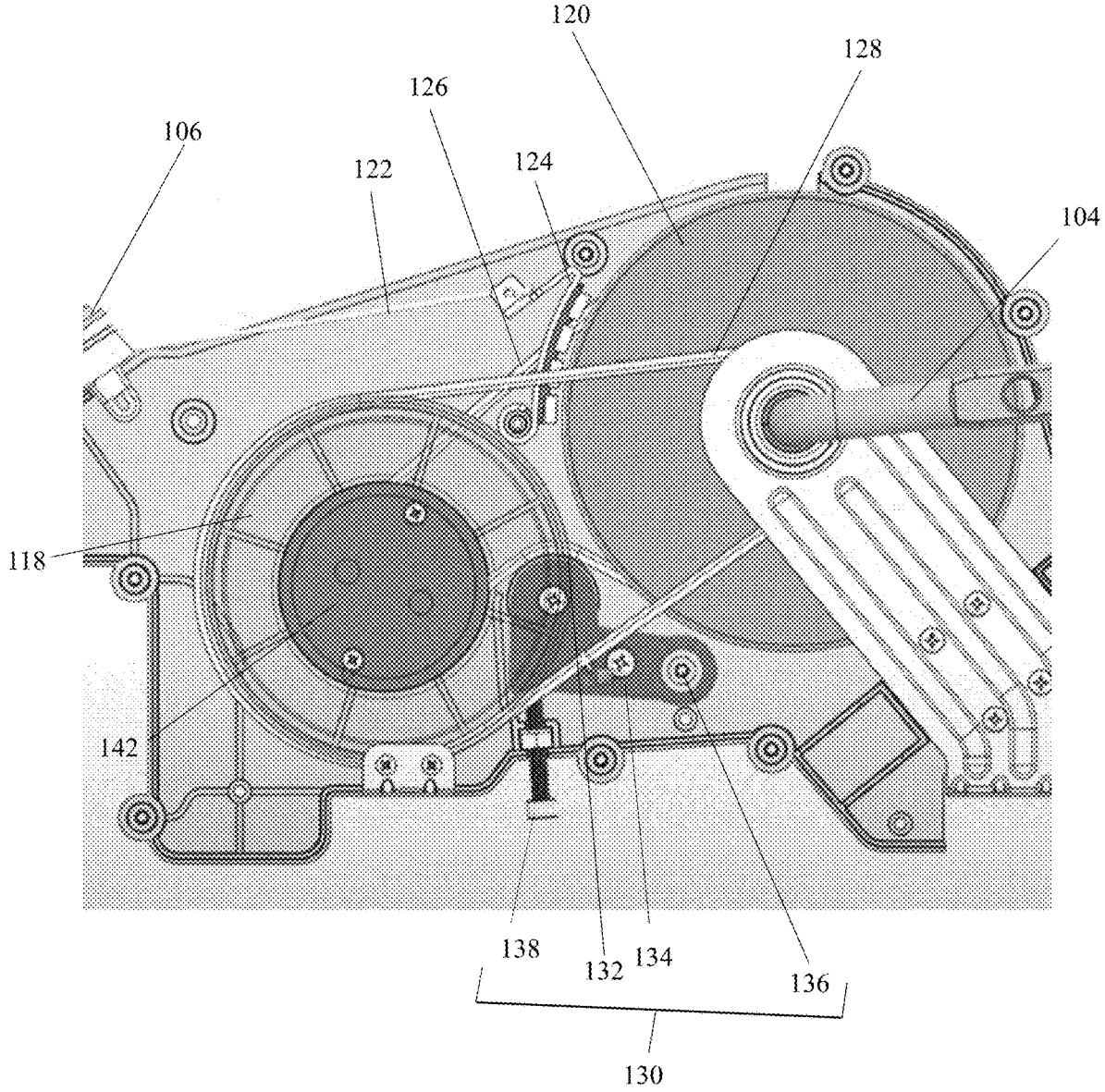
FIG. 10 is an enlarged view of the internal components of the exercise machine of FIG. 2, with a support arm in a first position.
Figure 11:
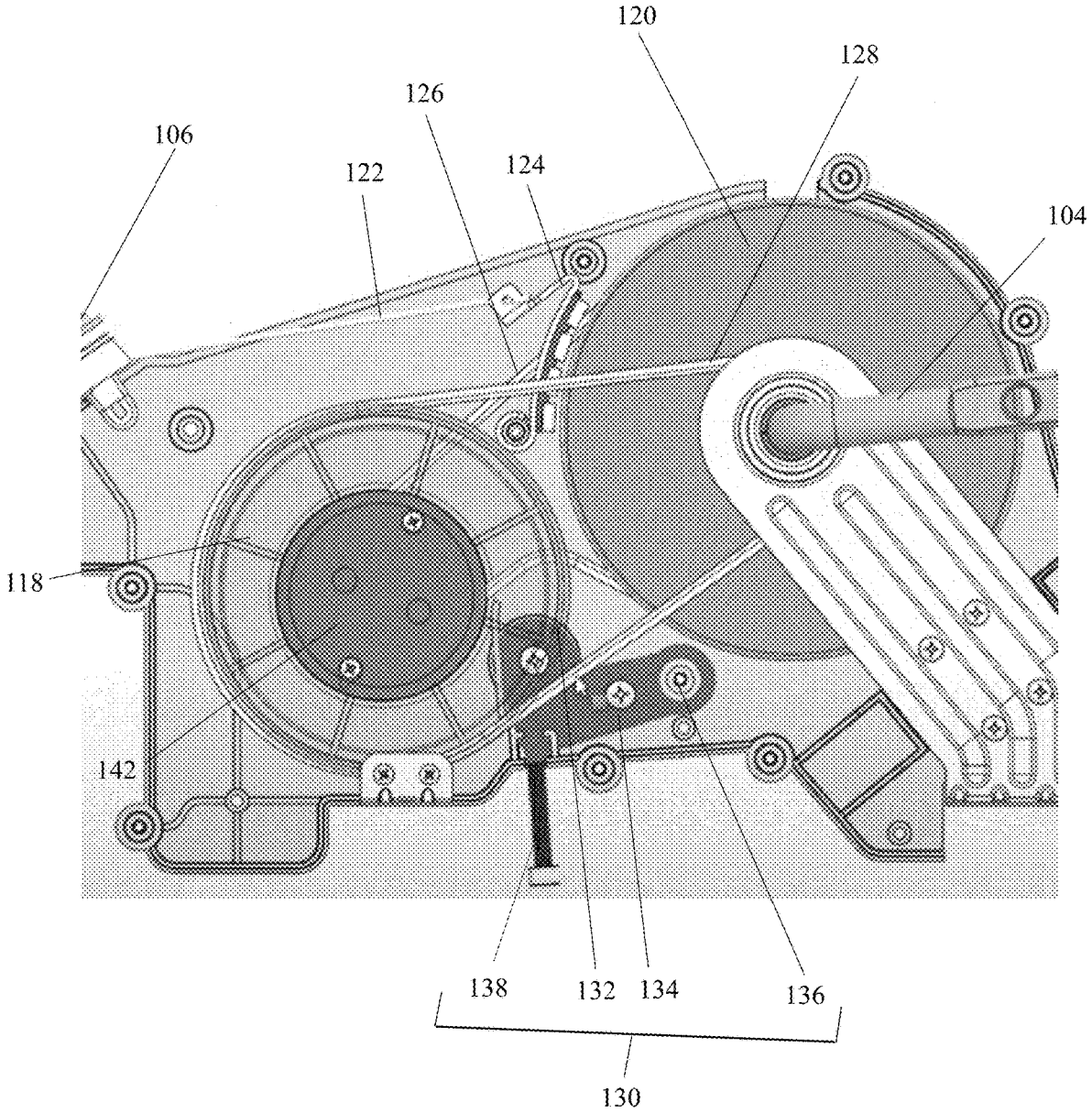
FIG. 11 shows the internal components of FIG. 10, with the support arm in a second position.

As shown in FIG. 9, in some embodiments, the crank arm may include a single rod or pole that is shaped (e.g., bent) into a desired configuration. In such embodiments, the crank arm may include portions having various shapes and thicknesses. For example, as shown in FIG. 9, the axle portion 153 may be substantially cylindrical in shape. In such an example, the ends of the crank arm may be substantially rectangular in cross-sectional shape to support connection to the pedal (e.g., via the shaft). As will be appreciated, in some embodiments, the crank arm also may be formed of one or more segments (e.g., an axle and two attachment arms) that are joined together (e.g., via welding, fasteners, or other suitable attachment members).

Figure 20:
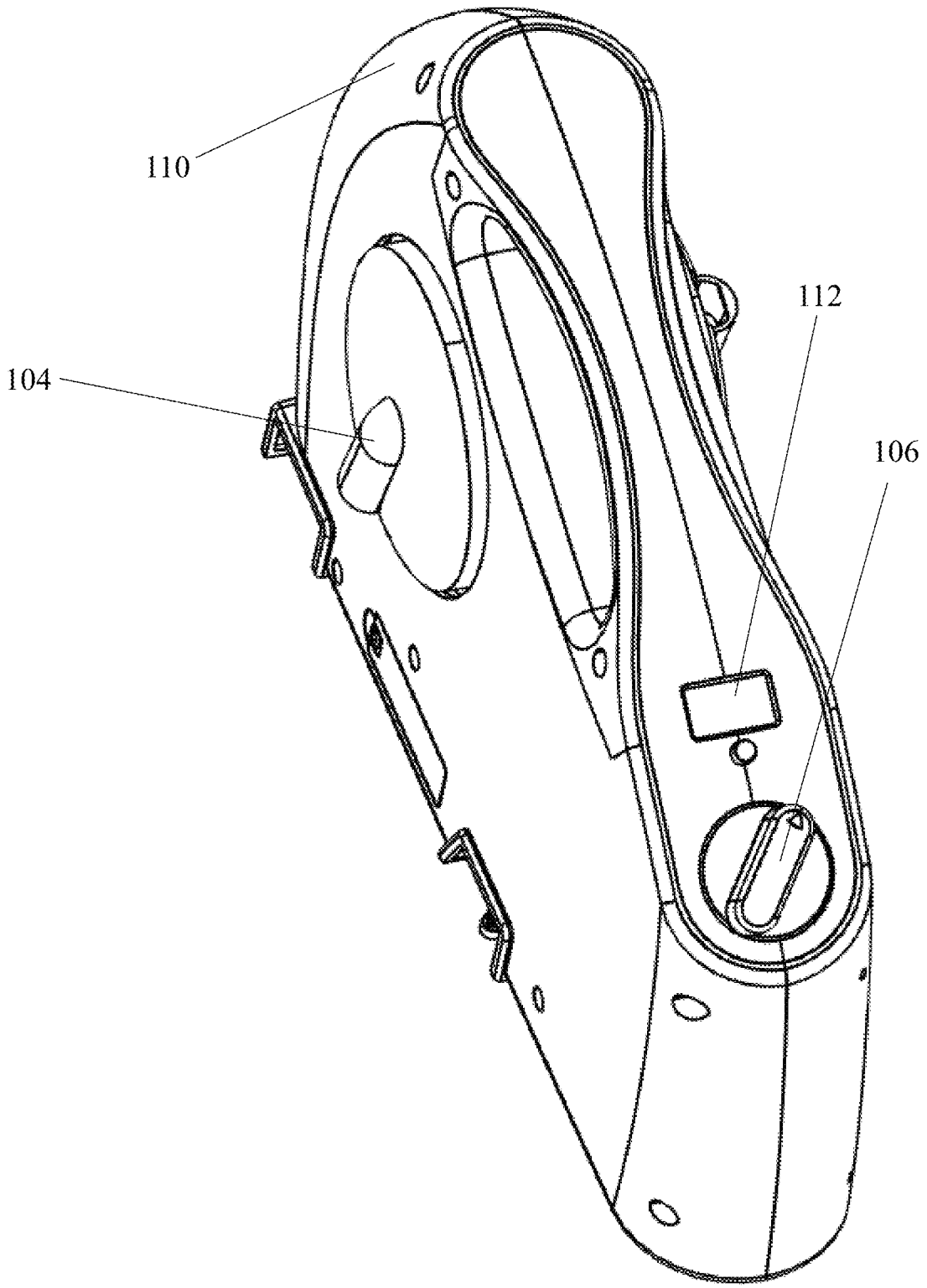
FIG. 20 shows a housing of the exercise machine of FIG. 2.

In some embodiments (see, e.g., FIGS. 1 and 20), housing 110 may include first and second covers that are joined together (e.g., using screws or any other suitable fastener). In some embodiments, the housing also may be formed of a plastic material, so as to reduce the overall weight of exercise machine 100. Of course, the housing 110 may alternatively be made of any suitable material (e.g., carbon fiber and/or composite materials) or combinations of materials.

In some embodiments, the crank arms are operably connected to a resistance adjuster disposed within the housing. In some embodiments, the resistance adjuster is configured to selectively apply a resistance to the crank arm so that the user may control a difficulty associated with the moving pedals 102. For example, as the resistance adjuster applies a greater resistance, the crank arms 104 may become more difficult to move about the housing. In another example, as the resistance adjuster applies less resistance, the crank arms 104 may become easier to move. In such embodiments, since the resistance adjuster may serve to modify a difficulty associated with moving the crank arm 104 via the pedals 102, the resistive assembly may serve to control and define the various difficulty levels of an exercise performed with exercise machine 100.

Figure 2:
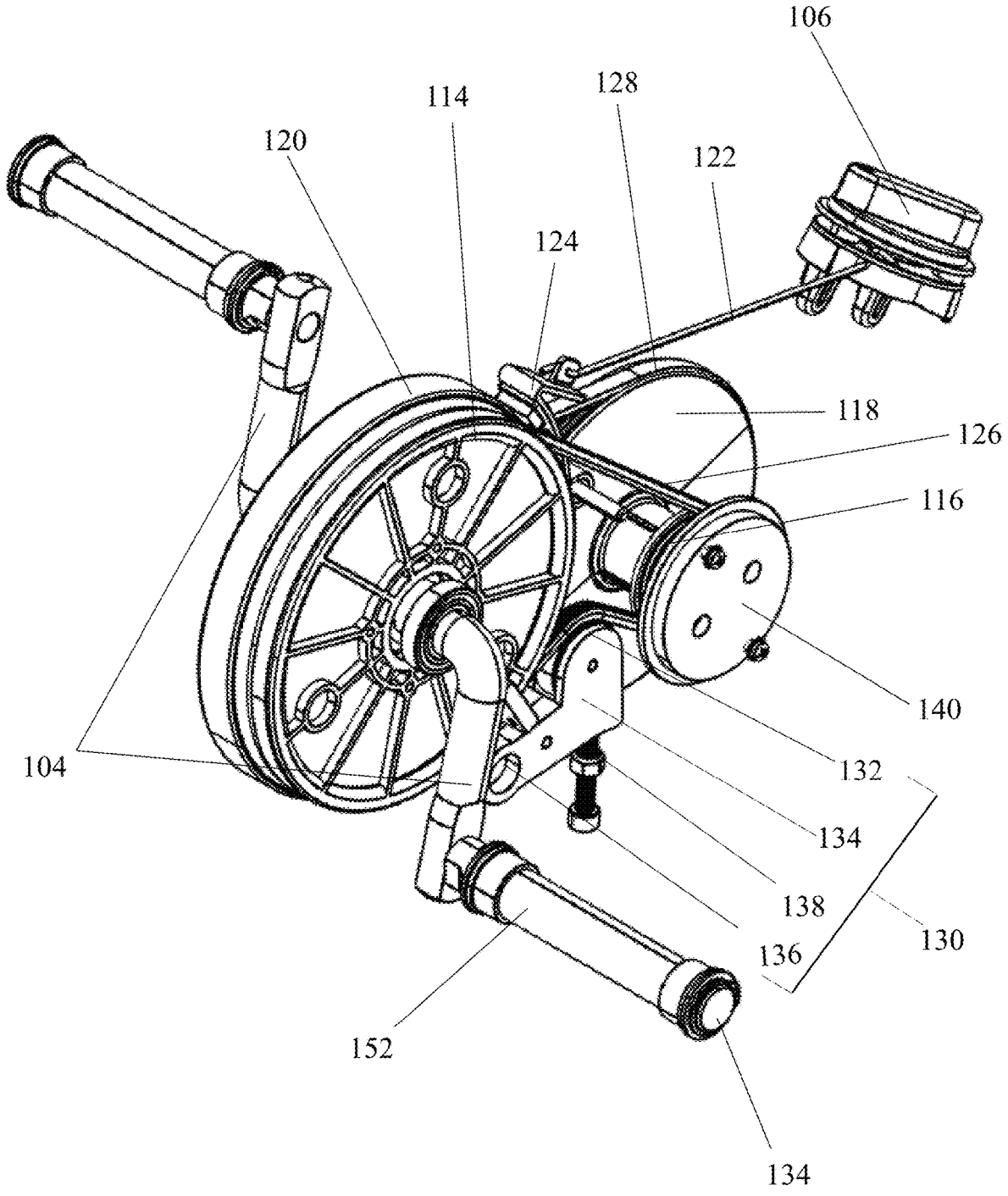
FIG. 2 is a perspective view of internal components of an exercise machine according to one embodiment.
Figure 3:
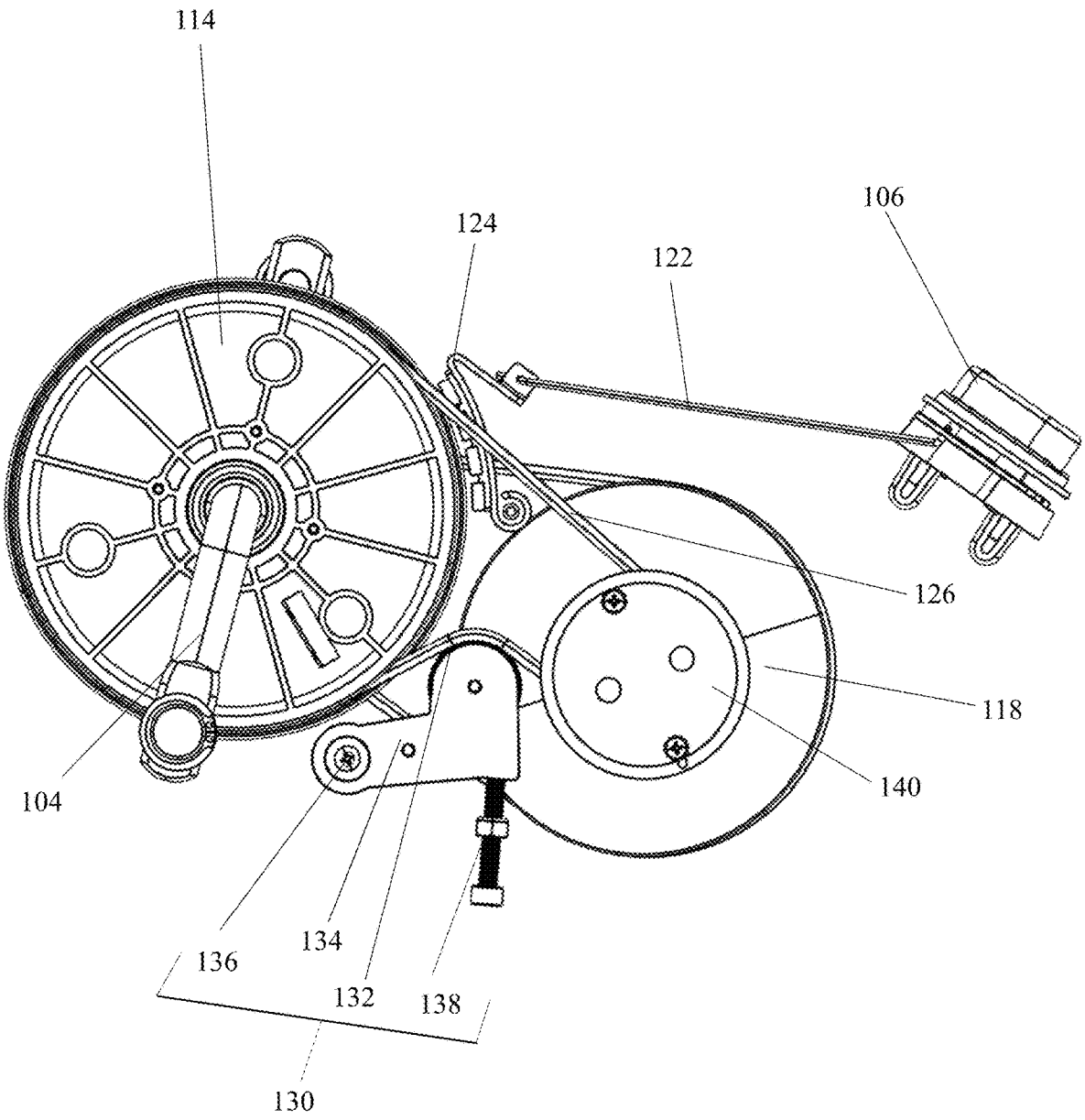
FIG. 3 is a right-side view of the internal components of FIG. 2.
Figure 4:
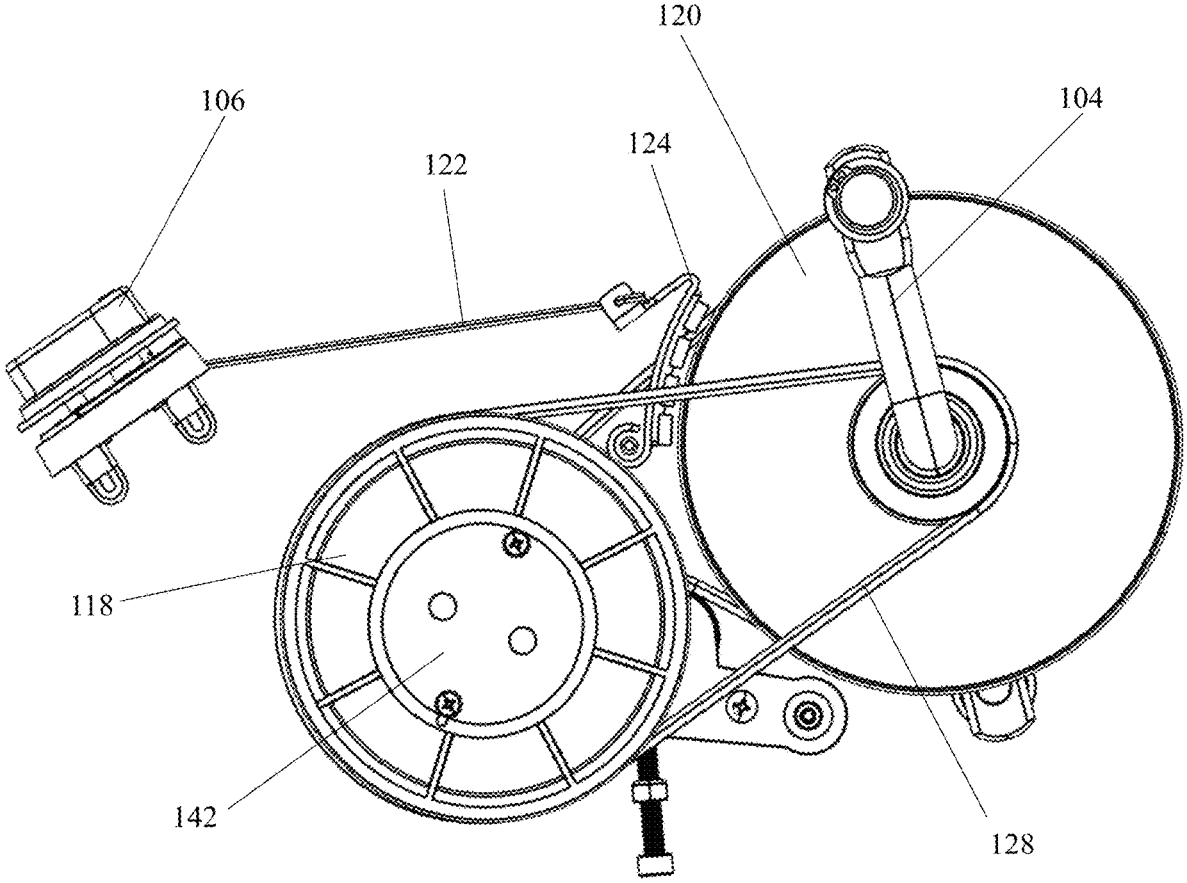
FIG. 4 is a left side view of the internal components of FIG. 2.

In some embodiments, as shown in FIG. 2, for example, the user may control the resistive assembly, and, in turn, the difficulty of the exercise machine, by operating a knob 106 operatively connected to the resistive assembly. For example, the user may turn the knob in a first direction to increase resistance and a second, opposite direction to decrease resistance.

In some embodiments, the exercise machine 100 may include a display 112 arranged to display one or more metrics related to an exercise performed on exercise machine 100. In some embodiments, such a display may indicate the desired difficulty level selected by the user. The display also may display the cadence, output, calories burned, average or instantaneous speed, and/or distance travelled. As will be appreciated, in some embodiments, the knob also may instead include indicia corresponding to the difficult levels. In such embodiments, the knob may be operated until the indicia corresponding to the desired difficulty level reaches a prescribed position on the housing.

Figure 5:
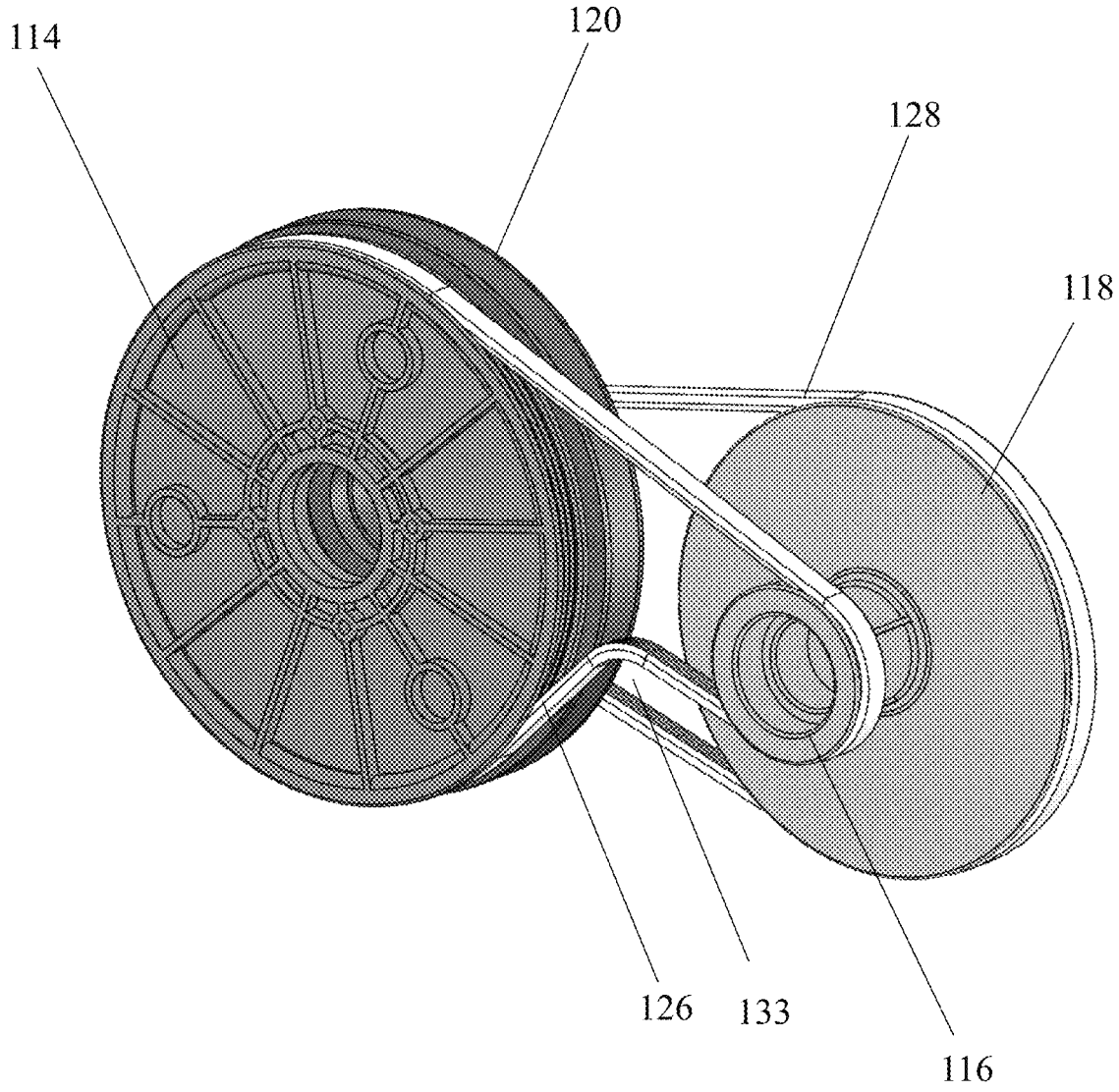
FIG. 5 is a perspective view of a pulley system of the exercise machine of FIG. 2.

FIGS. 2-19 show various views of the internal components (e.g., a drive mechanism, resistance adjuster, and/or belt tensioners) of exercise machine 100 according to some embodiments. In some embodiments, the exercise machine 100 may include a system of pulleys operatively connected by a series of belts to transmit a drive force applied at crank arm 104. In some embodiments, the drive force may be transmitted to a resistive body, such as flywheel 120. In the illustrated embodiment, crank arm 104 drives a first pulley 114. As shown best in FIG. 5, first pulley 114 is operatively connected (e.g., to transmits the drive force from crank arm 104) to a second pulley 116 via a first belt 126. In turn, second pulley 116 may be connected to a third pulley 118 to form a compound pulley. As will be appreciated, the first and second pulleys may be connected via any suitable arrangement. For example, the second pulley 116 in conjunction with third pulley 118 may form a compound pulley. In such an example, an axle may be coaxially connected to the second pulley and the third pulley. Third pulley 118 may be operatively coupled to the flywheel 120 via a second belt 128.

Figure 6:
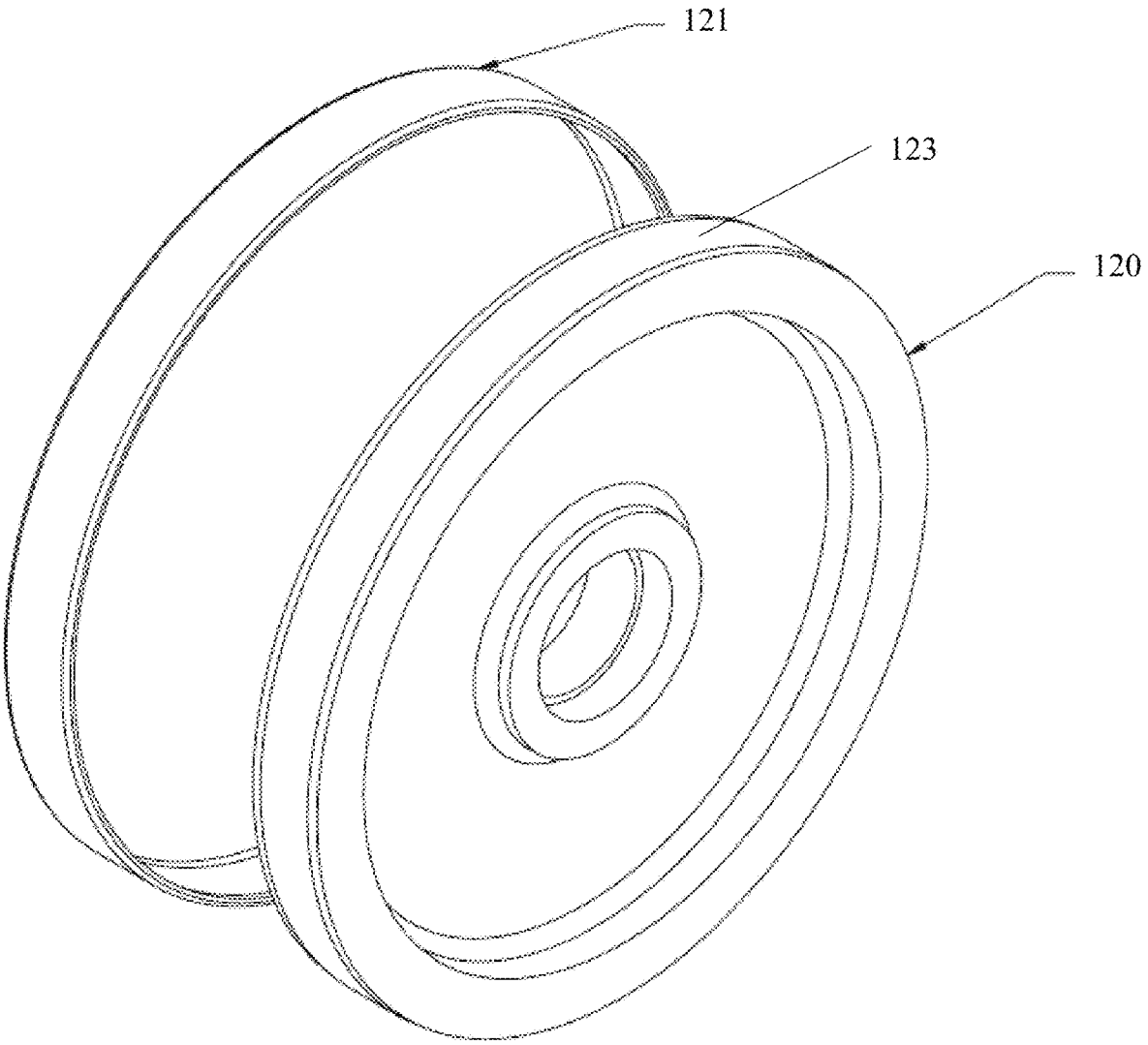
FIG. 6 is an exploded view of a flywheel of the exercise machine of FIG. 2.
Figure 7:
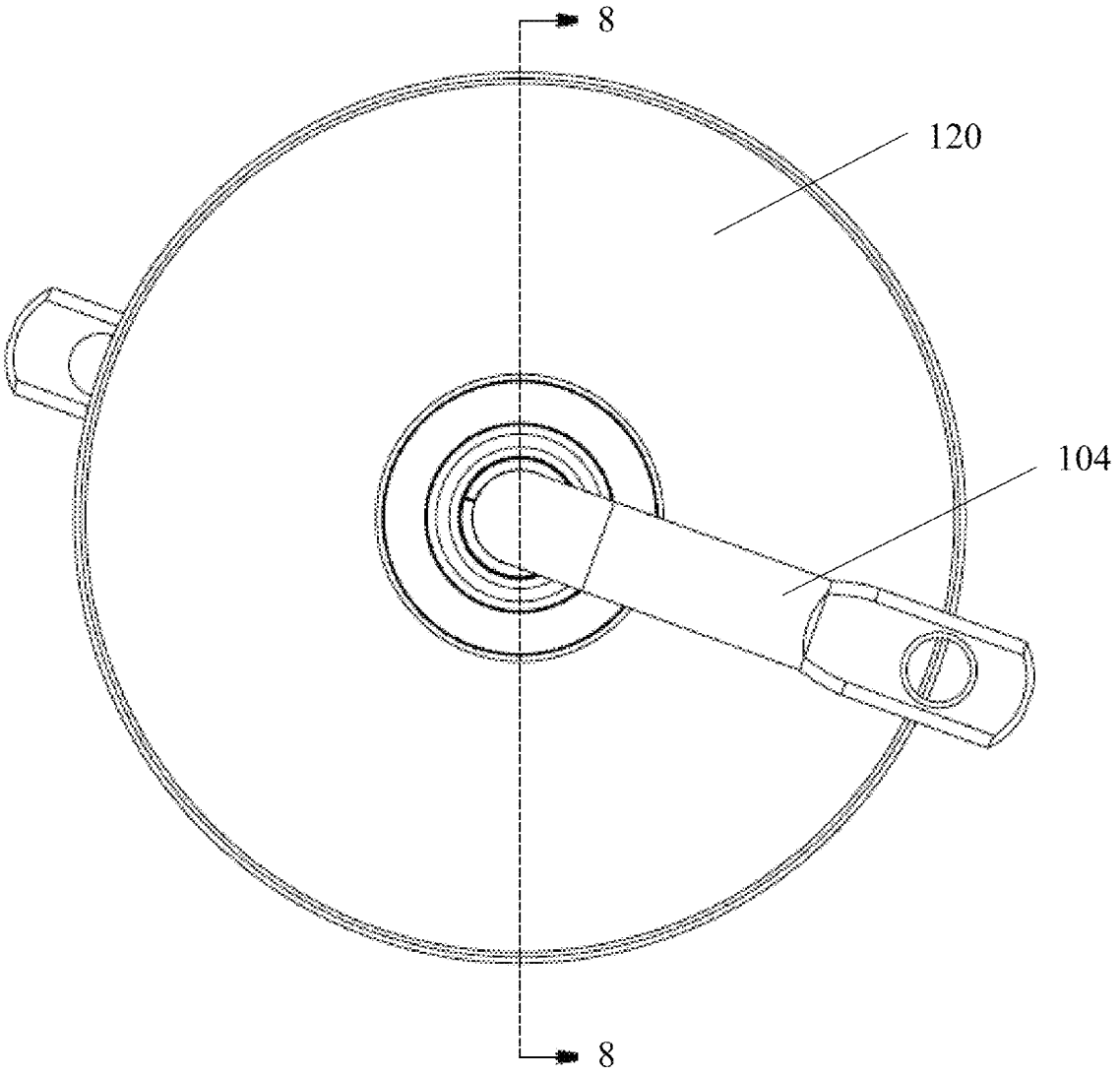
FIG. 7 is a side view of a pulley sub-assembly of an exercise machine according to one embodiment.
Figure 8:
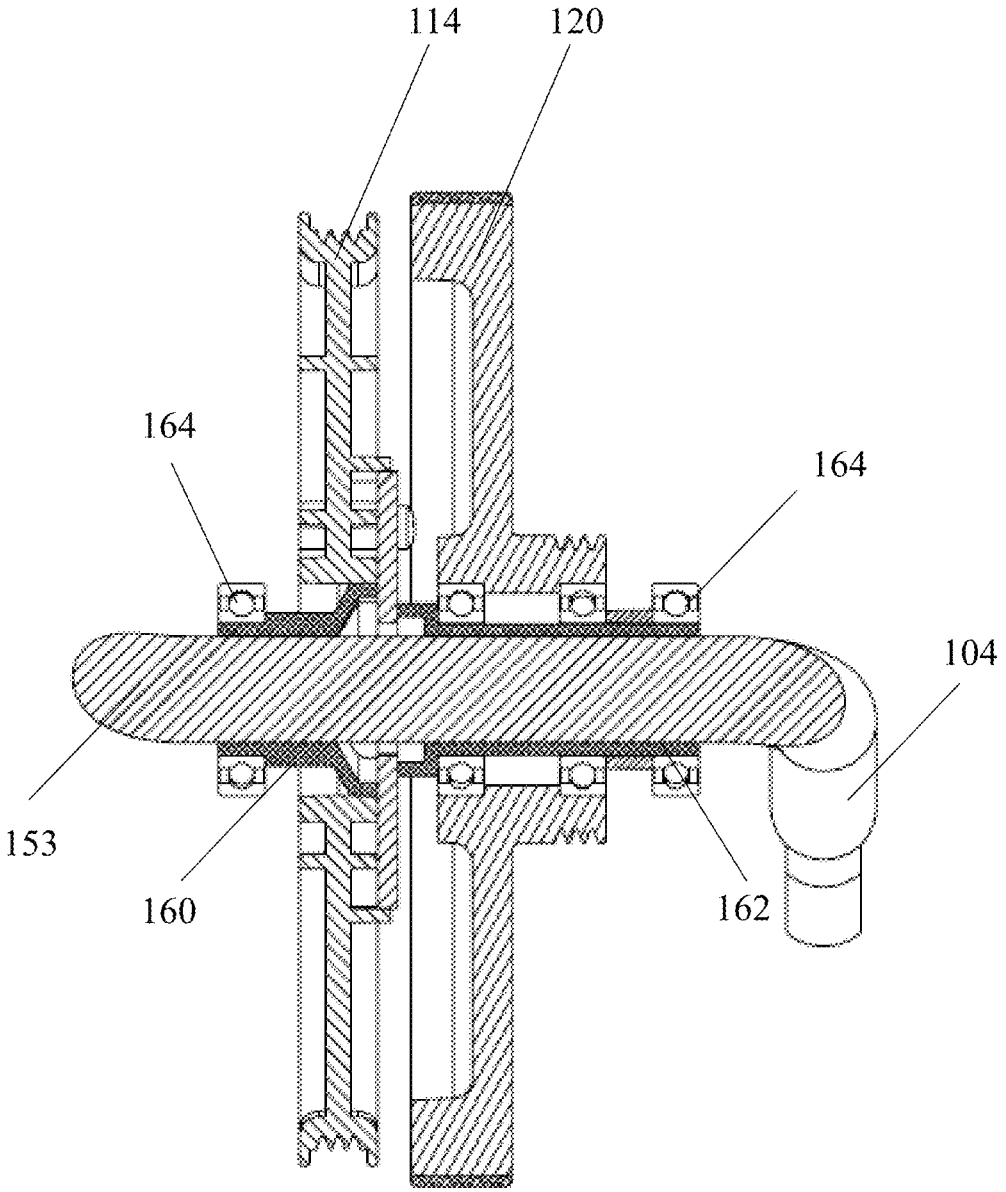
FIG. 8 is a cross-sectional view along lines 8-8 of FIG. 7.

In some embodiments, the flywheel 120 may be configured to control the force and/or torque needed to turn crank arm 104 (e.g., by a user's legs and/or feet). As shown in FIGS. 2-6, in the illustrated embodiment, the exercise machine 100 may include an eddy current brake having an array of magnets 124 configured to selectively adjust the resistance of flywheel 120. In some embodiments, the flywheel 120 may include a conductive surface. For example, as shown in FIG. 6, a conductive band 121 may surround the flywheel in some embodiments. In such an example, an outer surface of the flywheel may include a channel 123 for receiving the band. In some embodiments, the band may be formed of a thin piece of aluminum. As will be appreciated, the band may be formed of other suitable conductive materials. As will be further appreciated, in other embodiments, the flywheel may be coated with or otherwise at least partially formed of the conductive material. In some embodiments, the fly wheel may be formed of a ferromagnetic material (e.g., iron, cobalt, nickel, etc.), with an outer conductive surface.

In some embodiments, as the array of magnets 124 is moved toward the flywheel 120, the magnets may change a resistance of the conductive surface, causing the flywheel 120 to becomes more challenging to move (e.g., turn). As the array of magnets 124 are moved away from flywheel 120, flywheel 120 may become less challenging to move. In such embodiments, via the operative connections between the crank arm and flywheel, as the array of magnets are moved toward and/or away from the flywheel, the crank arm may become harder and/or less difficult to turn. Thus, a user may manipulate the difficultly of moving crank arm 104 by manipulating the distance between array of magnets 124 and flywheel 120. As will be appreciated, the array of magnets may have any suitable shape and size and any number of magnets. In some embodiments, the array may include four magnets, although more or fewer magnets may be used. In other embodiments, a single magnet may be movable relative to the flywheel.

As described herein, the distance between the array of magnets 124 and flywheel 120 may be controlled via the knob. In some embodiments, the knob may be operatively connected to the array of magnets 124 via a tie rod 122. For example, as the knob 106 is moved in a first, clockwise direction, the array of magnets 124 may be moved towards flywheel 120 via the tie rod. When the knob is moved in a second, counterclockwise direction, the array of magnets may be moved away from flywheel 120 via the tie rod.

Without wishing to be bound by theory, the distance between the array of magnets 124 and the flywheel 120 may form an exponential relationship with the resistance of flywheel 120. However, the exercise machine 100 may be configured such that the resistance of flywheel 120 is modified by a predetermined amount as the knob 106 is turned a predetermined distance. For example, in some embodiments, as knob 106 is turned a quarter turn clockwise, the resistance of flywheel 120 may increases by a predetermined amount, such as by 25%. Accordingly, the exercise machine 100 may allow knob 106 to evenly modify the resistance of flywheel 120, despite the exponential relationship between the resistance of flywheel 120 and the distance between magnetic array 124 and flywheel 120.

As will be appreciated, the knob may have any desired number of resistance levels for the exercise device. For example, the knob may have eight levels in some embodiments. In such embodiments, movement between each level may adjust the resistance of the flywheel by the same amount. For example, moving the knob from levels one to two may change the resistance by 10%, moving from the second level to the third level may change the resistance another 10% and so on. As will be appreciated, the change in resistance and corresponding movement of the knob may have other suitable levels in other embodiments.

Figure 12:
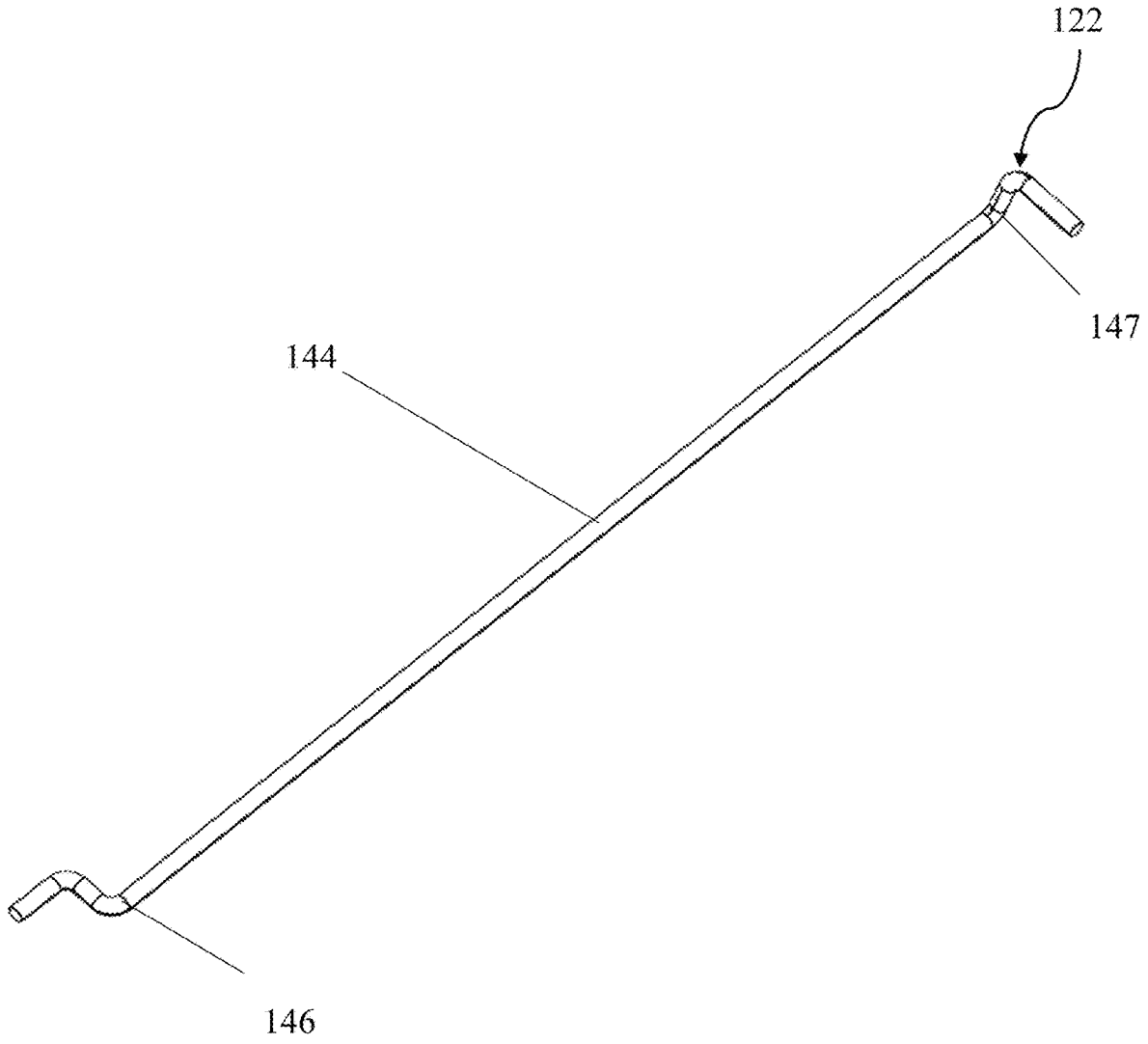
FIG. 12 is a perspective view of a tie rod according to one embodiment.

As shown in FIG. 12, the tie rod 122 may include a straight body portion 144 that is connected to the knob and to the magnetic array at first and second ends 146, 147. As will be appreciated, the rod may be attached to the knob and magnetic array in any suitable arrangements. In some embodiments, one of the ends 147 may be connected to and interface with array of magnets 124, while the other end 146 may be connected to and interfaces with (e.g., is driven by) knob 106.

In some embodiments, the rod may include contoured ends 146, 147, such as those shown in FIG. 12, to engage with the rod and/or magnetic array. In some embodiments, the contoured ends 146, 147 may be Z-shaped. As shown in FIG. 12, in some embodiments, a distal end of the Z shaped end (see Z-shaped end 146) may be substantially parallel with the straight body portion 144. In some embodiments, the distal end of the second Z-shaped end (see Z-shaped end 147) may be substantially perpendicular to the straight body portion 144. As will be appreciated, the contoured end portions may have other suitable shapes in other embodiments. For example, the contoured end portion also may include C-shaped, U-shaped, S-shaped, or another suitable shape.

The tie rod may be connected to the knob and the magnetic array via other suitable means. For example, in some embodiments, each end portion may be fastened to the knob and/or magnetic array via one or more fasteners, such as screws. Other arrangements may be used as will be appreciated by one of skill in the art.

Figure 13:
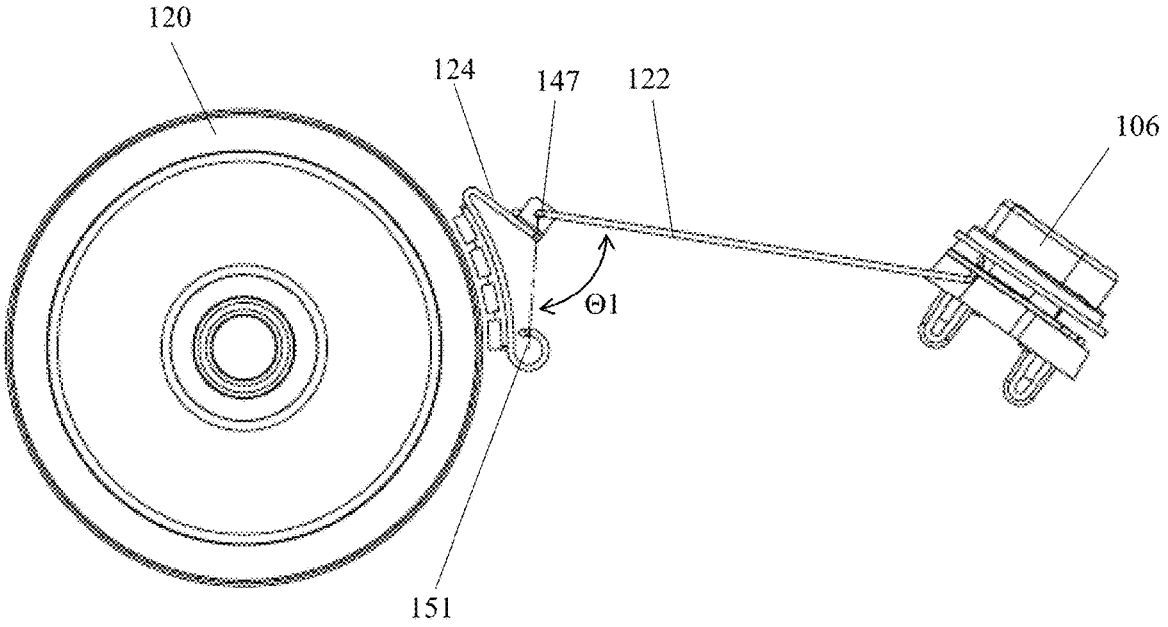
FIG. 13 is an enlarged view of internal components of an exercise machine according to one embodiment, with a magnetic array in a first position.
Figure 14:
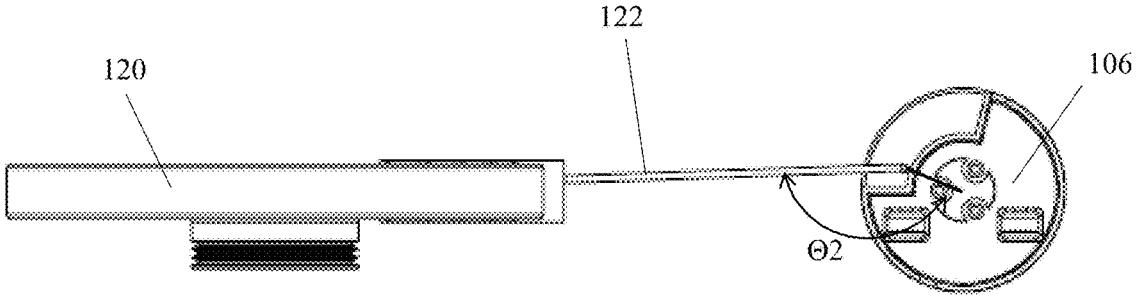
FIG. 14 is a bottom view of the internal components of FIG. 13.

In some embodiments, the straight rod may move the array of magnets 124 in an exponentially decreasing manner as knob 106 is turned, creating a linear relationship between knob 106 and the resistance of flywheel 120, as described herein. In some embodiments, as the knob is operated, an angle θ1 of the tie rod 122 relative to the array of magnets and/or an angle θ2 of the tie rod relative to the knob may be varied. For example, in some embodiments, when the array of magnets is moved towards the flywheel (see FIGS. 13 and 14), the magnetic effect may be strong and very sensitive to distance. In such embodiments, the magnet may need to be moved less relative to the knob rotation. As shown in FIG. 13, in some embodiments, the angle θ1 between the rod and the array of magnets (see distal end 151) may be about 90 degrees when the magnetic array is close to the flywheel. In some embodiments, this 90-degree angle may mean that movement of the rod may result in the least possible movement of the magnet, which may be needed at higher resistance settings. As shown in FIG. 14, the angle θ2 between the tie rod and the knob may be greater than 90 degrees in such embodiments. For example, the angle θ2 between the tie rod and the knob may be greater than 90 degrees but less than 180 degrees. In an illustrative example, the angle θ2 may be closer to 180 degrees than 90 degrees. In such embodiments, this angle may have the maximum effect of moving the rod the least for a given knob rotation, which, in turn, may move the magnet much less for a given knob rotation.

Figure 15:
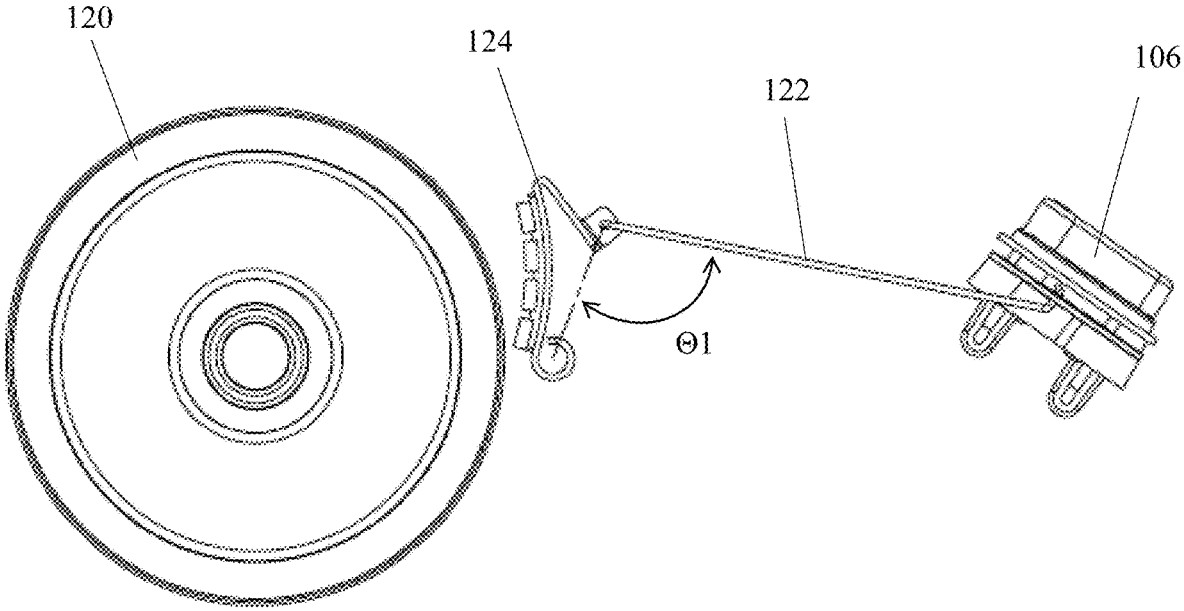
FIG. 15 shows the internal components of FIG. 13 with the magnetic array in a second position.
Figure 16:
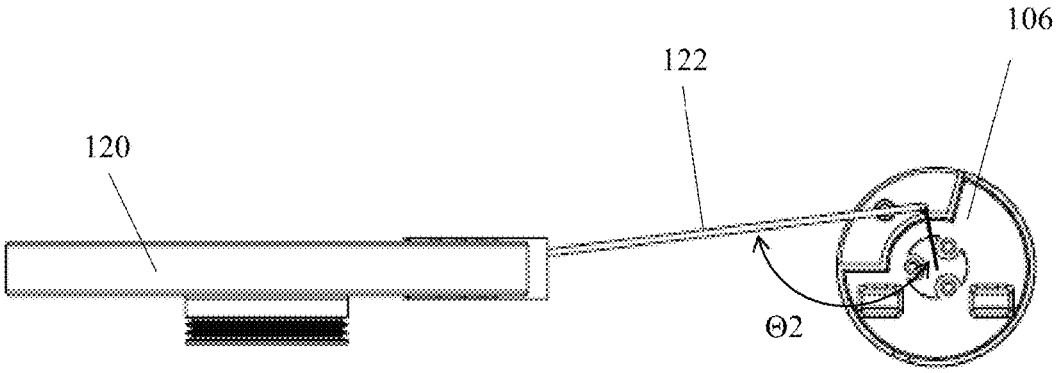
FIG. 16 is a bottom view of the internal components of FIG. 15.
Figure 17:
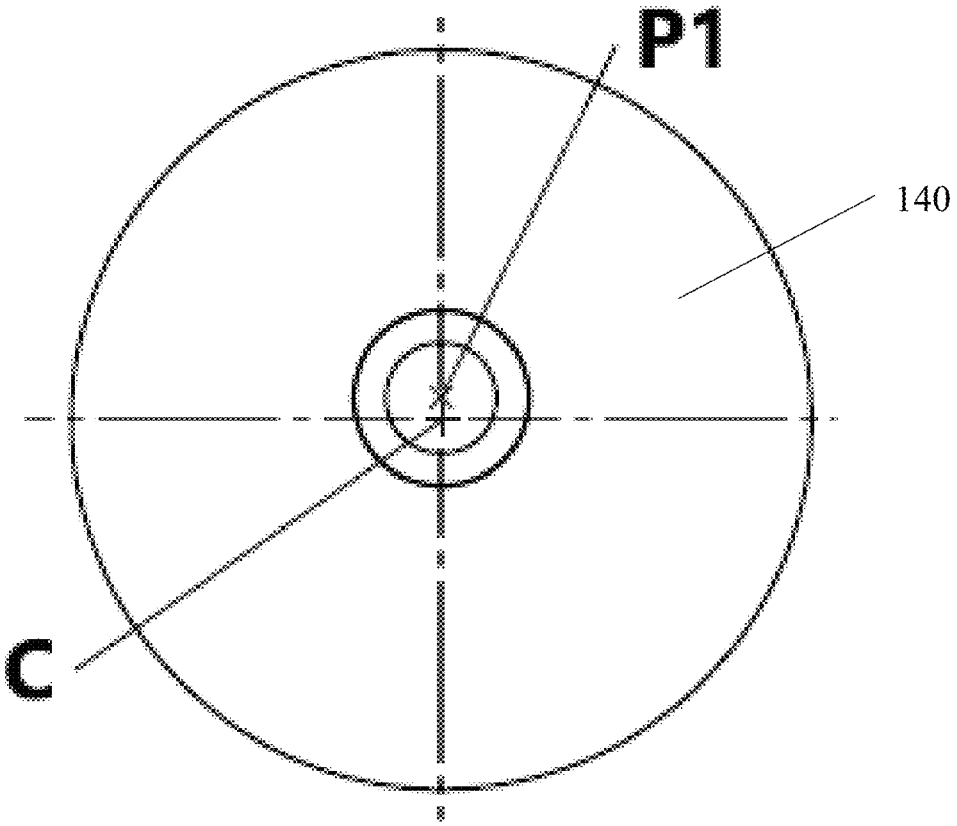
FIG. 17 is a first shaft support of the exercise machine of FIG. 2.

As the array of magnets is moved away from the flywheel (e.g., decreasing resistance), the magnetic effect is weakening. In such embodiments, the magnet may need to move more relative to the knob rotation. In some embodiments, as shown in FIG. 15, the angle θ1 between the tie rod and the array of magnets may be greater than 90 degrees. In such embodiments, movement of the rod may result in more magnetic movement, which may be needed at lower resistance settings. A shown in FIG. 16, the angle θ2 between the tie rod and the knob may be about 90 degrees in such embodiments. Such a 90-degree angle may have the maximum effect of moving the rod the most for a given knob rotation, which, in turn, may move the magnet further for a given knob rotation.

As described herein, one or more of the belts may need tensioning during manufacturing to maintain appropriate functionality of the device. FIGS. 2-4, 10-11, and 17-19 illustrate features that may allow the first belt 126 and second belt 128 to be tensioned.

In some embodiments, the exercise machine 100 may be arranged to first tension the second belt 128. For example, in some embodiments, the exercise machine 100 may include a first tensioner having a first shaft support 140 and a second shaft support 142 (see FIGS. 3 and 4). In some embodiments, the supports are attached to either ends of a shaft which the compound pulley rides on. In such embodiments, the compound pulley formed of the second and third pulleys 116, 118 (as described herein) may move relative to first pulley 114.

Figure 18:
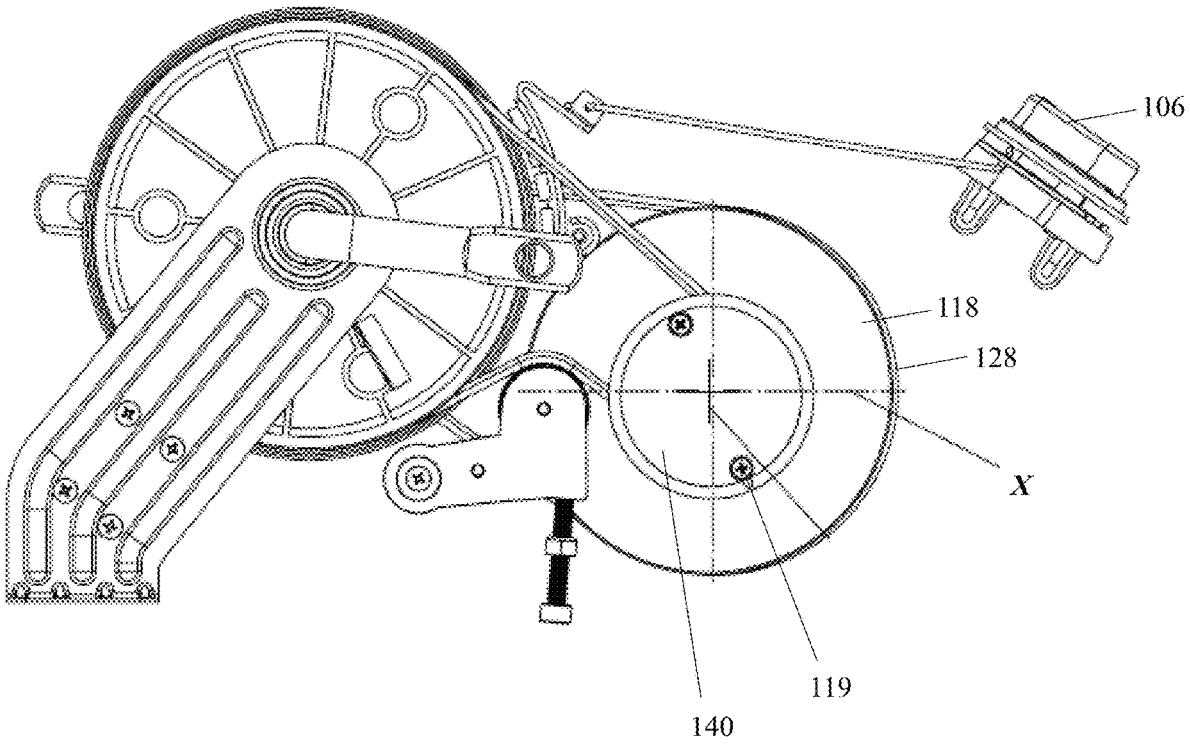
FIG. 18 is a side view of internal components of an exercise machine, with a first shaft support shown in a first position.
Figure 19:
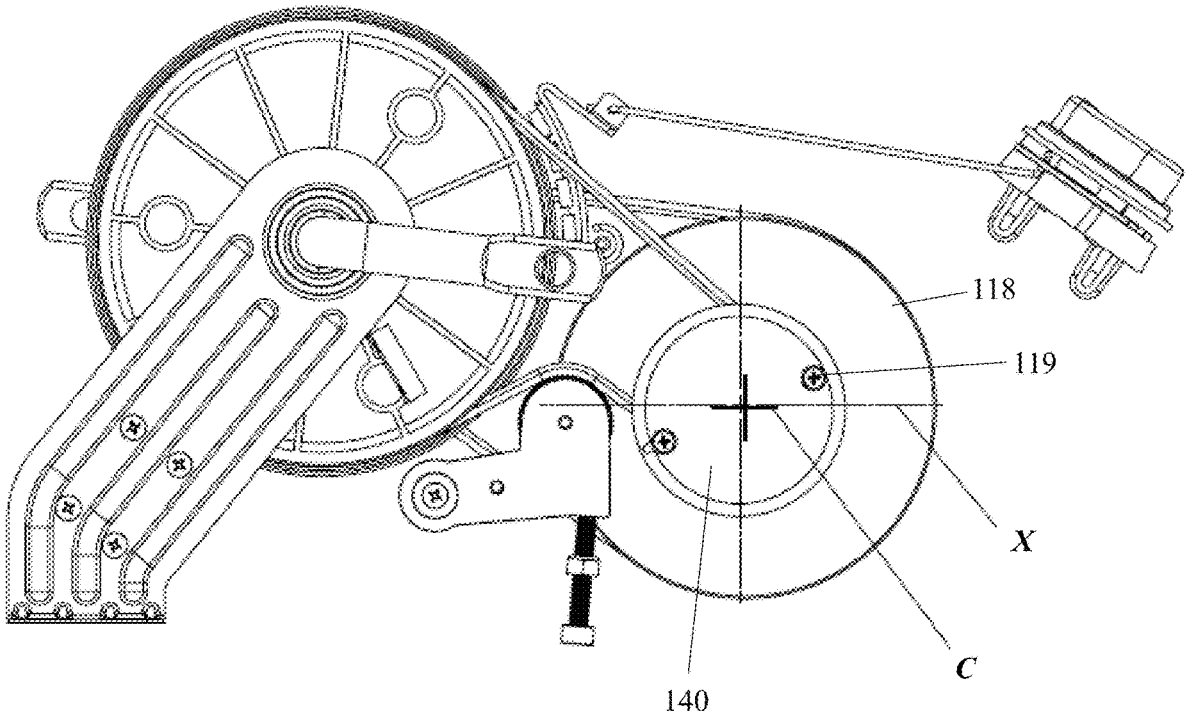
FIG. 19 shows the internal components of FIG. 18 with the first shaft support shown in a second position.

In some embodiments, a pivot axis P1 of the first shaft support 140 may be offset from a central axis C of the of the first shaft support. FIG. 18 illustrates an example in which the second belt 128 is loose (see the belt extending outwardly from a right side of the third pulley) and the first shaft support 140 is in a first position. To tension the second belt, the first shaft support 140 may be rotated clockwise, and the compound pulley formed by second and third pulleys 116, 118 may move away from first pulley 114. See, for example, FIG. 19, in which the first shaft support is in a second position, with the belt 128 tensioned. The cross labeled X in FIG. 19 represents a central axis of an ideal location of the second belt 128 in some embodiments. As will be appreciated, the first shaft support 140 also may be rotated counterclockwise, with the compound pulley formed by second and third pulleys 116, 118 moving towards first pulley 114, thus decreasing the tension in second belt 128.

In the illustrated embodiment, the first and second shaft supports 140, 142 are configured to move relative to the housing along an arc trajectory due to the eccentricity. As will be appreciated, the shaft supports may move in other suitable trajectories. For example, in some embodiments, first and second shaft supports 140, 142 may be configured to move relative to the housing linearly, angularly, or in any other suitable manner, depending on the application.

In some embodiments, first and/or second shaft supports 140, 142 and the second and/or third pulleys may be selectively fixed in a desired orientation. For example, in some embodiments, the first and/or second shaft supports 140, 142 may be selectively fixed in a desired orientation using a fastener (see fastener 119 in FIG. 18), such as a screw. Other fasteners also may be used to selectively fix the desired orientation, such as nails, rivets, and/or standoffs. Of course, any suitable fastener may be employed, depending on the application, as will be appreciated by a person of skill in the art.

The exercise machine 100 also may include a second belt tensioner 130 configured to set the tension of the first belt 126. In some embodiments, the second belt tensioner 130 may include a ball bearing 132, which contacts and presses on first belt 126. In some embodiments, the first belt is arranged to be too loose when not tensioned. In such embodiments, when appropriately tensioned, the first belt 126 may include a kink 133 (e.g., where the tensioning bearing may push).

In some embodiments, the ball bearing 132 may be located on a first end of a support arm 134. In such embodiments, the support arm may include includes a fixed pivot point 136 at a second, opposite end of support arm 134. In some embodiments, pivot point 136 may be fixed to a portion of exercise machine 100 such that the support arm 134 may pivot about the pivot point 136. In some embodiments, to adjust the tension of the first belt 126, the user may pivot support arm 134 such that ball bearing 132 moves towards first belt 126 (e.g., counterclockwise in the configuration of FIG. 3). The user also may relieve tension from first belt 126 by pivoting support arm 134 such that the ball bearing 132 moves away from first belt 126 (e.g., clockwise in the configuration of FIG. 3).

In some embodiments, the user may pivot support arm 134 by manipulating a bolt 138 or other suitable fastener. For example, in some embodiments, as the user turns the bolt 138 in a first direction (e.g., tightening the bolt), the bolt may move the support arm 134 in a counterclockwise direction about the pivot axis, thus contacting the first belt and increasing the tension of belt 126 (see FIG. 7). Conversely, as bolt 138 is turned in a second, opposite direction, the support arm 134 may move in a counterclockwise direction about the pivot axis, thus decreasing the tension in first belt 126 (see FIG. 8). Bolt 138 may also be selectively locked in some embodiments to fix the tension in first belt 126 to a desired value. Such functionality may be achieved by fixing bolt 138 in place with a desired length of bolt 138 exposed.

As described herein, the second belt may be tensioned prior to tensioning the first belt. As will be appreciated, in other embodiments, the belts may be tensioned at the same time, or the second belt may be tensioned after the first belt. As will be further appreciated, other suitable belt tensioners may be used in other suitable arrangements.

Figure 22:
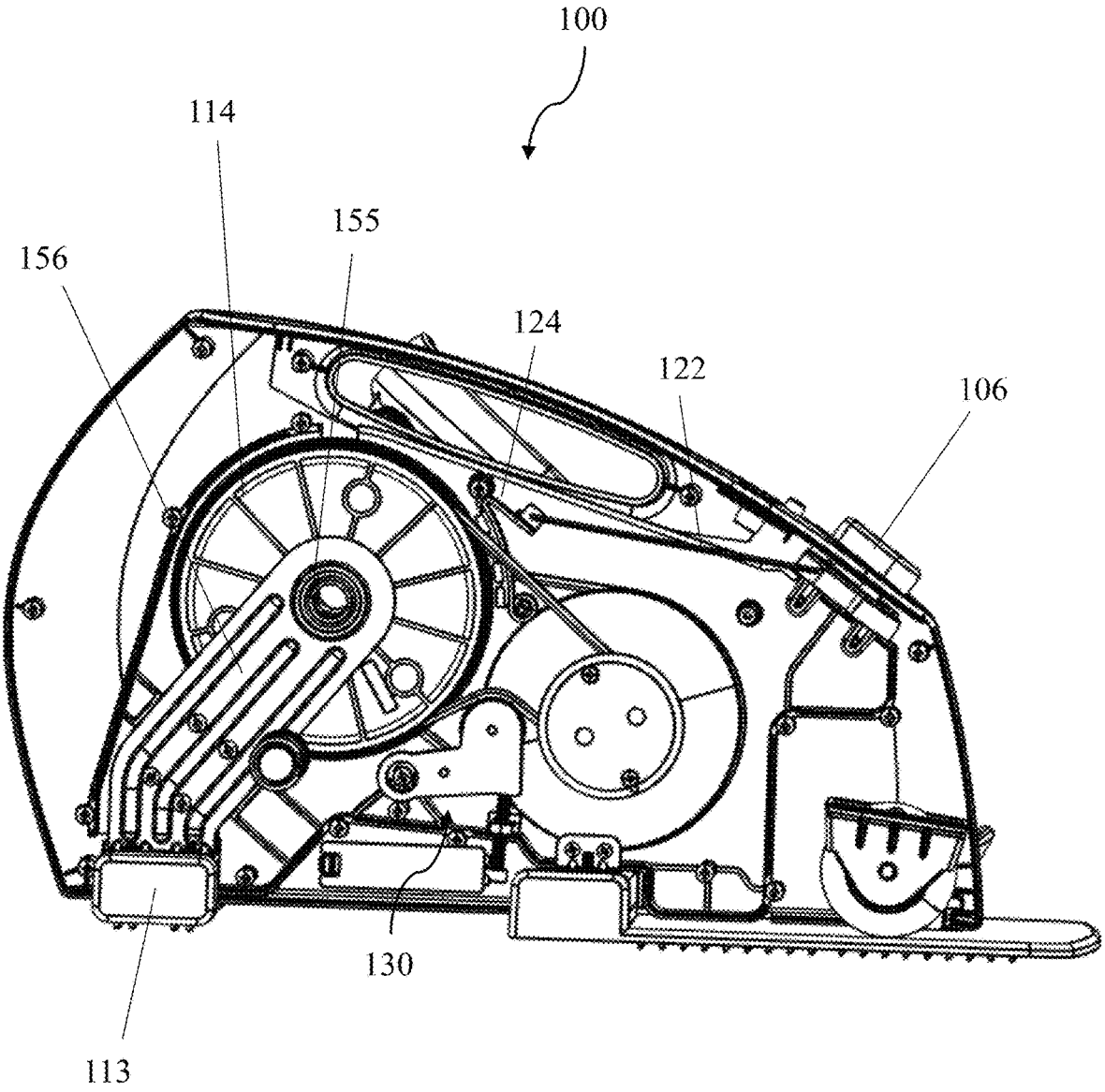
FIG. 22 is a side view of the housing of FIG. 20 with a cover shown removed.

As descried herein, the exercise machine may include a predominately plastic construction. In some embodiments, the exercise machine also may include one or more metal components. As shown in FIG. 22, for example, the exercise machine 100 also may include a metal support brace 156 extending between the bearings 155 to which the crank arm is attached and the feet. In some embodiments, the metal brace 156 may serve to add additional structural rigidity to the exercise machine 100. In some embodiments, the brace also may be arranged to transfer input forces (e.g., external forces and/or torques), such as when a user applies forces and/or torques to pedals 102 to the feet. In such embodiments, the brace may allow the device to remain stably on a surface (e.g., floor) as the user continues to pedal. In some embodiments, the feet also may be formed of a metal component.

As described herein, in some embodiments, the crank arm may be formed of a single unitary pole or rod. In such embodiments, each of the components of the pulley sub assembly (see, e.g., FIGS. 8 and 9) must slide onto one of the ends of the crank arm and to the axle portion. In some embodiments, because of the curved shape between the axle portion 153 and the first and second ends, and because of the different thicknesses of the crank arm, the pulleys and bearings 166 must each include an inner opening (see FIG. 9) that is larger than a diameter of the axle portion. Accordingly, in some embodiments, the sub assembly may include first and second couplers 160, 162 that are disposed on the axle portion and onto which the pulleys, bearings, and/or fly wheel are disposed (see FIG. 8). In some embodiments, as shown in FIG. 9, each coupler may include first and second halves that are attached to each other. As will be appreciated, in such embodiments, each half of the coupler may be snapped onto the axle portion and attached to each other.

In some embodiments, each coupler may have one or more contact surfaces arranged to contact a pulley, fly wheel and/or bearing. In such embodiments, the couplers may be arranged to appropriately space the pulleys, flywheel, and/or bearings from one another. The sub assembly also may include one or more spacers 168, where appropriate, to space one or more sub assembly components. In some embodiments the crank arm also may include a central place 164 to which the various components may be attached.

Various aspects of the present disclosure may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

The embodiments described herein may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Further, some actions are described as taken by a "user." It should be appreciated that a "user" need not be a single individual, and that in some embodiments, actions attributable to a "user" may be performed by a team of individuals and/or an individual in combination with computer-assisted tools or other mechanisms.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

While the present teachings have been described in conjunction with various embodiments and examples, it is not intended that the present teachings be limited to such embodiments or examples. On the contrary, the present teachings encompass various alternatives, modifications, and equivalents, as will be appreciated by those of skill in the art. Accordingly, the foregoing description and drawings are by way of example only.

What is claimed is:

1. A tensioning system for an exercise apparatus comprising:

a first pulley configured to receive a driving force;

a second pulley operatively connected to the first pulley via a first belt;

a third pulley operatively connected to the second pulley;

an axle coaxially connected to the second pulley and the third pulley;

a flywheel operatively connected to the third pulley via a second belt;

a first belt tensioner having at least two eccentric shaft supports operatively connected to the second and third pulleys, wherein the at least two eccentric shaft supports are configured to modify a tension of the second belt when the at least two eccentric shaft supports are rotated; and a second belt tensioner having a ball bearing and a support arm, wherein the ball bearing is mounted to a first end of the support arm and pivotable about a second end of the support arm, the ball bearing being configured to contact the first belt.

2. The tensioning system of claim 1, wherein movement of the first end of the support arm in a first direction about a pivot axis of the second end of the support arm increases a tension of the first belt.

3. The tensioning system of claim 2, wherein movement of the first end of the support arm in a second, opposite direction about the pivot axis decreases the tension of the first belt.

4. The tensioning system of claim 3, wherein the first direction is a direction toward the first belt and the second direction is a direction away from the first belt.

5. The tensioning system of claim 2, wherein the support arm is selectively lockable to tension the first belt.

6. The tensioning system of claim 1, wherein the first belt tensioner is configured to tension the second belt before the second belt tensioner is configured to tension the first belt.

7. The tensioning system of claim 1, wherein a first shaft support is configured to move the axle in an arc-like motion when the first shaft support is rotated.

8. The tensioning system of claim 1, wherein the at least two eccentric shaft supports are selectively lockable in a fixed position.

9. The tensioning system of claim 1, wherein rotating the at least two eccentric shaft supports moves the second and third pulleys relative to the first pulley.

10. The tensioning system of claim 1, wherein the second and third pulleys are formed into a compound pulley.

* * * * *